US012089795B2

(12) United States Patent
Park

(10) Patent No.: US 12,089,795 B2
(45) Date of Patent: Sep. 17, 2024

(54) DISHWASHER

(71) Applicant: LG Electronics Inc., Seoul (KR)

(72) Inventor: Dong Hwi Park, Seoul (KR)

(73) Assignee: LG Electronics Inc., Seoul (KR)

( * ) Notice: Subject to any disclaimer, the term of this patent is extended or adjusted under 35 U.S.C. 154(b) by 335 days.

(21) Appl. No.: 17/321,065

(22) Filed: May 14, 2021

(65) Prior Publication Data

US 2021/0353124 A1 Nov. 18, 2021

(30) Foreign Application Priority Data

May 15, 2020 (KR) ..... 10-2020-0058483

(51) Int. Cl.

| | |
|---|---|
| ***A47L 15/14*** | (2006.01) |
| ***A47L 15/16*** | (2006.01) |
| ***A47L 15/42*** | (2006.01) |
| ***A47L 15/50*** | (2006.01) |

(52) U.S. Cl.

CPC ..... *A47L 15/4278* (2013.01); *A47L 15/14* (2013.01); *A47L 15/16* (2013.01); *A47L 15/4214* (2013.01); *A47L 15/4246* (2013.01); *A47L 15/4289* (2013.01); *A47L 15/508* (2013.01)

(58) Field of Classification Search

None

See application file for complete search history.

(56) References Cited

U.S. PATENT DOCUMENTS

| | | | |
|---|---|---|---|
| 3,415,259 | A | 12/1968 | Noren et al. |
| 10,517,458 | B2 | 12/2019 | Wilson et al. |
| 2011/0030742 | A1 | 2/2011 | Dalsing et al. |
| 2015/0257623 | A1 | 9/2015 | Beshears et al. |
| 2018/0220870 | A1 | 8/2018 | Beshears et al. |

FOREIGN PATENT DOCUMENTS

| | | |
|---|---|---|
| WO | WO2020169521 | 8/2020 |

OTHER PUBLICATIONS

Extended European Search Report in European Appln. No. 21173879.4, dated Oct. 13, 2021, 10 pages.

*Primary Examiner* — Levon J Shahinian

(74) *Attorney, Agent, or Firm* — Fish & Richardson P.C.

(57) ABSTRACT

A dishwasher includes: a tub defining a washing space, a sump disposed at a lower portion of the washing space and configured receive water, a plurality of nozzles disposed at the washing space and configured to spray the water received in the sump toward an object in an upward direction, and a wash water guide configured to supply the water in the sump to each of the plurality of nozzles and disposed at the washing space. The wash water guide includes a main wash water guide, a plurality of sub wash water guides respectively branched from the main wash water guide, and a plurality of connection parts connecting the main wash water guide to the plurality of sub wash water guides, and an angle between at least one connection part of the plurality of connection parts and the main wash water guide is an acute angle.

18 Claims, 21 Drawing Sheets

DISHWASHER

CROSS-REFERENCE TO RELATED APPLICATION

This application claims priority to and the benefit of Korean Patent Application No. 10-2020-0058483, filed on May 15, 2020, the disclosure of which is incorporated herein by reference in its entirety.

TECHNICAL FIELD

Disclosed herein is a dishwasher.

BACKGROUND

Dishwashers are devices that wash contaminants such as leftovers on an object to the washed including cooking vessels or cooking tools and the like using detergent and wash water.

Some of the dishwashers of the related art are provided with subsidiary nozzles for washing a cylindrical bottle (e.g., a nursing bottle) having a hollow inside.

FIG. 1 is a view showing an example of a structure of a subsidiary nozzle and a wash water guide included in a dishwasher of the related art.

Referring to FIG. 1, a dishwasher of the related art sprays wash water into a plurality of bottles as an object to be washed using a plurality of subsidiary nozzles 10. The plurality of subsidiary nozzles 10 may be supplied with the wash water through a wash water guide 20.

However, the dishwasher of the related art cannot ensure a uniform spray height or pressure of wash water spraying from the plurality of subsidiary nozzles 10 due to a structure of the wash water guide 20. That is, the structure, in which the wash water guide 20 has no gentle connection parts, can cause some of the plurality of subsidiary nozzles 10 to spray wash water at a low spray height or pressure. In this case, bottles washed by some of the subsidiary nozzles having a low spray height or pressure cannot be rightly washed.

A dishwasher is disclosed in US Patent Publication No. US10517458B2 as other example of the related art.

Referring to the other example of the related art, a manifold is disposed in the dishwasher, and wash water moves to an inlet of the manifold. In the manifold, a plurality of channels (i.e., flow paths) connect in a matrix form, and a docking port is arranged at a plurality of positions of the manifold. A spray device and the like connects to the docking port, and wash water sprays to the spray device.

A flow direction of the washing water in the plurality of channels is parallel to a floor surface of a washing space and is almost horizontal. Accordingly, there is almost no difference in potential energy caused due to gravity between the washing water. In the dishwasher of the other example of the related art, since a flow rate of wash water discharged out of a channel near the inlet decreases, a flow rate or a water pressure of wash water supplied to a channel far from the inlet decreases.

SUMMARY

Technical Problem

The present disclosure is directed to a dishwasher that may be provided with a plurality of nozzles configured to spray wash water at a uniform height or pressure.

The present disclosure is also directed to a dishwasher that may prevent a reduction in the flow rate of wash water and energy loss caused by division of the wash water from a main wash water guide to each of a plurality of sub wash water guides.

The present disclosure is also directed to a dishwasher that may be provided with a wash water guide having a structure in which a spray pressure of a plurality of nozzles is properly divided.

The present disclosure is also directed to a dishwasher that may wash a plurality of objects to be washed uniformly.

The present disclosure is also directed to a dishwasher that may reduce deviation in washing performance for a plurality of objects to be washed.

The present disclosure is also directed to a dishwasher that may adjust a spray height of wash water from each of the plurality of nozzles uniformly with time.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via means and combinations thereof that are described in the appended claims.

Technical Solution

In a dishwasher according to the present disclosure, at least one of a plurality of connection parts configured to connect a main wash water guide and a plurality of sub wash water guides may connect to the main wash water guide at an acute angle.

Specifically, the dishwasher may include a wash water guide and a plurality of nozzles connected to the wash water guide, the wash water guide may include a main wash water guide, a plurality of sub wash water guides and a plurality of connection parts, and shapes of the plurality of connection parts may be formed into a curved line or a straight line, to allow wash water spraying from the plurality of nozzles to spray at a uniform spray height or pressure and to allow the plurality of nozzles to wash a plurality of objects to be washed uniformly.

Additionally, in the dishwasher according to the present disclosure, the main wash water guide may have a non-uniform shape or the plurality of sub wash water guides may have different cross-sectional areas, to allow wash water spraying from the plurality of nozzles to spray at a uniform spray height or pressure and to reduce deviation in wash performance for a plurality of objects to be washed.

A dishwasher in one embodiment may include a tub defining a washing space, a sump that is disposed at a lower portion of the washing space and that is configured receive water, a plurality of nozzles that is disposed at the washing space and that is configured to spray the water received in the sump toward an object in an upward direction, and a wash water guide that is configured to supply the water in the sump to each of the plurality of nozzles and that is disposed at the washing space. The wash water guide comprises a main wash water guide, a plurality of sub wash water guides respectively branched from the main wash water guide, and a plurality of connection parts connecting the main wash water guide to the plurality of sub wash water guides, and an angle between at least one connection part of the plurality of connection parts and the main wash water guide is an acute angle.

Each of the plurality of connection parts comprises (i) a first sub connection part connecting the main wash water guide to a first lateral surface of the sub wash water guide and (ii) a second sub connection part connecting the main wash water guide to a second lateral surface of the sub wash water guide, and a first distance between the first lateral surface of the sub wash water guide and a wash water inlet of the main wash water guide is shorter than a second distance between the second lateral surface of the sub wash water guide and the wash water inlet of the main wash water guide.

At least one of the plurality of connection parts is curved.

The plurality of sub wash water guides comprises one or more pairs of sub wash water guides spaced apart from each other with respect to the wash water inlet of the main wash water guide, and each of the one or more pairs of sub wash water guides comprises a first sub wash water guide part and a second sub wash water guide part facing each other, the plurality of connection parts comprises one or more pairs of connection parts, and each of the one or more pairs of connection parts comprises a first connector connected to the first sub wash water guide part and a second connector connected to the second sub wash water guide part, and the plurality of nozzles comprises a first nozzle connected to the first sub wash water guide part and a second nozzle connected to the second sub wash water guide part.

A first part of the first connector that connects a first lateral surface of the first sub wash water guide part to a first lateral surface of the main wash water guide is curved, and a first part of the second connector that connects a first lateral surface of the second sub wash water guide part to a second lateral surface of the main wash water guide is curved.

A second part of the first connector that connects a second lateral surface of the first sub wash water guide to the first lateral surface of the main wash water guide has a shape of a right angle or a horizontal line, and a second part of the second connector that connects a second lateral surface of the second sub wash water guide to a second lateral surface of the main wash water guide has a shape of a right angle or a horizontal line.

A second part of the first connector that connects a second lateral surface of the first sub wash water guide to the first lateral surface of the main wash water guide is curved, and a second part of the second connector that connects a second lateral surface of the second sub wash water guide to the second lateral surface of the main wash water guide is curved.

A second part of the first connector that connects a second lateral surface of the first sub wash water guide to a central line of the main wash water guide is curved, and a second part of the second connector that connects a second lateral surface of the second sub wash water guide to the central line of the main wash water guide is curved.

A curvature of the at least one of the plurality of connection parts is (i) directly proportional to a size of each of the first nozzle and the second nozzle and (ii) inversely proportional to a cross-sectional area of each of the first sub wash water guide part and the second sub wash water guide part.

Based on a size of the first nozzle and a size of the second nozzle being equal and a cross-sectional area of the first sub wash water guide part and a cross-sectional area of the second sub wash water guide part being equal, a curvature of the first connector and a curvature of the second connector are same.

Based on a cross-sectional area of the first sub wash water guide part and a cross-sectional area of the second sub wash water guide part being equal and a size of the first nozzle being greater than a size of the second nozzle, a curvature of the first connector is greater than a curvature of the second connector.

Based on a size of the first nozzle and a size of the second nozzle being equal and a cross-sectional area of the first sub wash water guide part being greater than a cross-sectional area of the second sub wash water guide part, a curvature of the first connector is less than a curvature of the second connector.

Any one connection part of the at least one of the plurality of connection parts is closer to the wash water inlet of the main wash water guide than the other connection part of the at least one of the plurality of connection parts, and a curvature of the any one connection part is less than a curvature of the other connection part.

A cross-sectional area of the main wash water guide decreases as a distance from a washing water inlet of the main wash water guide increases.

Any one sub wash water guide of the plurality of sub wash water guides is closer to the wash water inlet of the main wash water guide than the other sub wash water guide of the plurality of sub wash water guides, and a cross-sectional area of a first portion of the main wash water guide disposed between the any one sub wash water guide and the wash water inlet of the main wash water guide is greater than a cross-sectional area of a second portion of the main wash water guide disposed between the any one sub wash water guide and the other sub wash water guide.

A cross-sectional area of a first end of the first portion of the main wash water guide is greater than or equal to a cross-sectional area of a second end of the first portion of the main wash water guide, a cross-sectional area of a first end of the second portion of the main wash water guide is greater than or equal to a cross-sectional area of a second end of the second portion of the main wash water guide, the cross-sectional area of the second end of the first portion of the main wash water guide is greater than the cross-sectional area of the first end of the second portion of the main wash water guide, the first end of the first portion of the main wash water guide is closer to the wash water inlet of the main wash water guide than the second end of the first portion of the main wash water guide, and the first end of the second portion of the main wash water guide is closer to the wash water inlet of the main wash water guide than the second end of the second portion of the main wash water guide.

The plurality of sub wash water guides and the plurality of connection parts have a zigzag shape and are disposed on a first lateral surface and a second lateral surface of the main wash water guide.

Any one sub wash water guide of the plurality of sub wash water guides is closer to a wash water inlet of the main wash water guide than the other sub wash water guide of the plurality of sub wash water guides, and a cross-sectional area of the other sub wash water guide is less than a cross-sectional area of the any one sub wash water guide.

A dishwasher in another embodiment may include a tub defining a washing space, a plurality of nozzles that is disposed at the washing space and that is configured to spray water toward an object, and a wash water guide configured to supply the water to each of the plurality of nozzles. The wash water guide comprises a main wash water guide, and a plurality of sub wash water guides respectively branched from the main wash water guide, and a cross-sectional area of the main wash water guide is reduced gradually in a lengthwise direction with respect to a wash water inlet of the main wash water guide.

A dishwasher in yet another embodiment may include a tub defining a washing space, a plurality of nozzles that is disposed at the washing space and that is configured to spray water toward an object, and a wash water guide configured to supply the water to each of the plurality of nozzles. The wash water guide comprises a main wash water guide, and a plurality of sub wash water guides respectively branched from the main wash water guide, and a cross-sectional area of a first guide of the plurality of sub wash water guides differs from a cross-sectional area of a second guide of the plurality of sub wash water guides.

Advantageous Effect

According to the present disclosure, wash water may spray to a plurality of objects to be washed at a uniform height or pressure.

According to the present disclosure, a reduction in the flow rate of wash water and energy loss, caused by division of wash water from a main wash water guide to each of a plurality of sub wash water guides, may be prevented.

According to the present disclosure, despite a difference size of the plurality of nozzles, wash water may spray to a plurality of objects to be washed uniformly.

According to the present disclosure, despite a different length of a plurality of subsidiary guides, wash water may spray to a plurality of objects to be washed uniformly.

According to the present disclosure, deviation in wash performance for a plurality of objects to be washed may be reduced.

According to the present disclosure, a spray height of wash water from each of the plurality of nozzles may be uniformly controlled with time.

Specific effects are described along with the above-described effects in the section of Detailed Description.

BRIEF DESCRIPTION OF DRAWING

The accompanying drawings constitute a part of the specification, illustrate one or more embodiments in the disclosure, and together with the specification, explain the disclosure, wherein.

DETAILED DESCRIPTION

Figure 1:
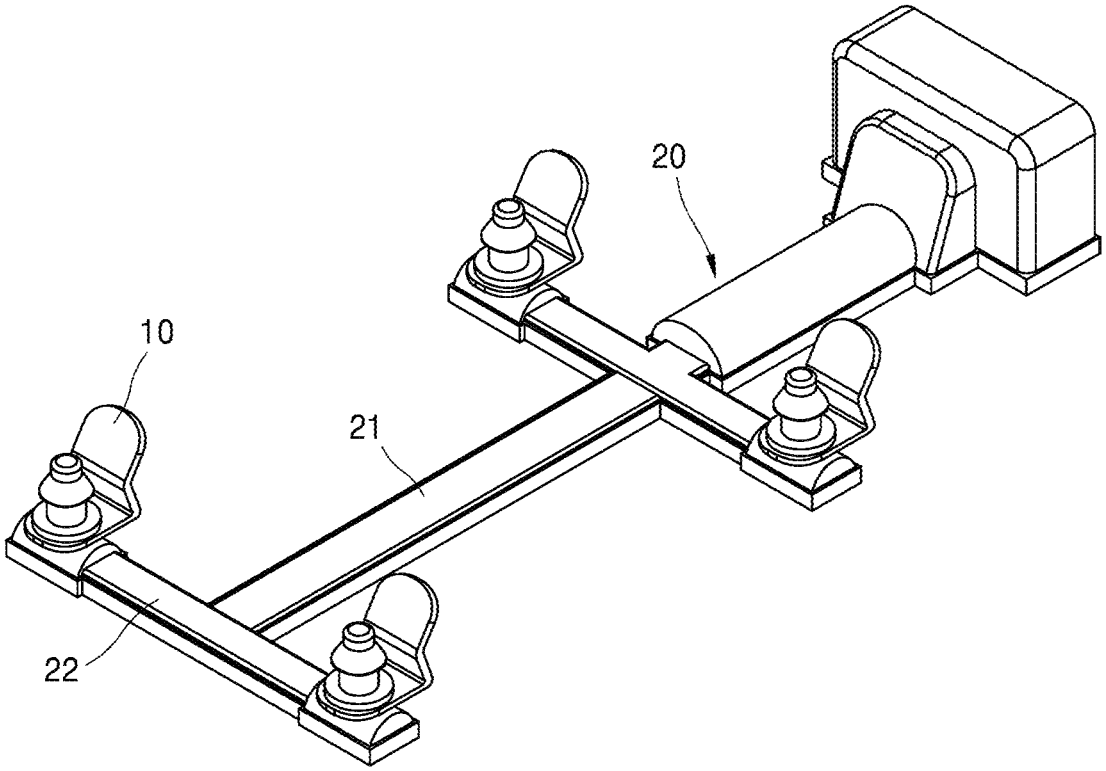
FIG. 1 is a view showing a structure of a part of a dishwasher of the related art.

The above-described aspects, features and advantages are specifically described hereunder with reference to the accompanying drawings such that one having ordinary skill in the art to which the present disclosure pertains can easily implement the technical spirit of the disclosure. In the disclosure, detailed description of known technologies in relation to the disclosure is omitted if it is deemed to make the gist of the disclosure unnecessarily vague. Below, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component unless stated to the contrary.

When one component is described as being "in an upper portion (or a lower portion)" of another component, or "on (or under)" another component, one component can be placed on the upper surface (or under the lower surface) of another component, and an additional component may be interposed between another component and one component on (or under) another component.

When one component is described as being "connected", "coupled", or "connected" to another component, one component can be directly connected, coupled or connected to another component. However, it is also to be understood that an additional component can be "interposed" between the two components, or the two components can be "connected", "coupled", or "connected" through an additional component.

Throughout the disclosure, each component can be provided as a single one or a plurality of ones, unless explicitly stated to the contrary.

The singular forms "a", "an" and "the" are intended to include the plural forms as well, unless explicitly indicated otherwise. It should be further understood that the terms "comprise" or "have" and the like, set forth herein, are not interpreted as necessarily including all the stated components or steps but can be interpreted as excluding some of the stated components or steps or can be interpreted as further including additional components or steps.

Throughout the disclosure, the terms "A and/or B" as used herein can denote A, B or A and B, and the terms "C to D" can denote C or greater and D or less, unless stated to the contrary.

Below, a dishwasher according several embodiments is described.

[Basic Structure of Dishwasher]

Figure 2:
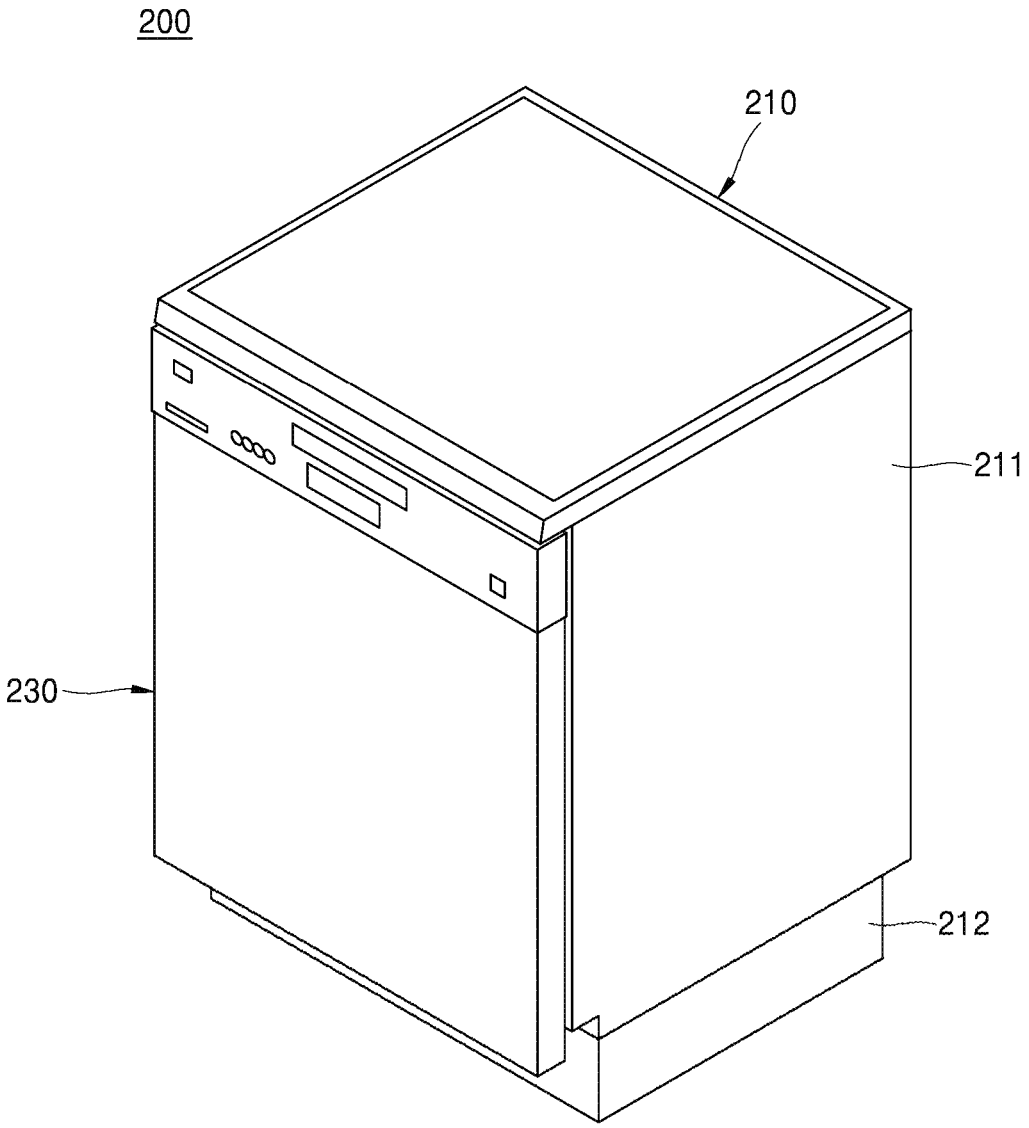
FIG. 2 is a perspective view showing a dishwasher in one embodiment, which is seen from a right upper side.
Figure 3:
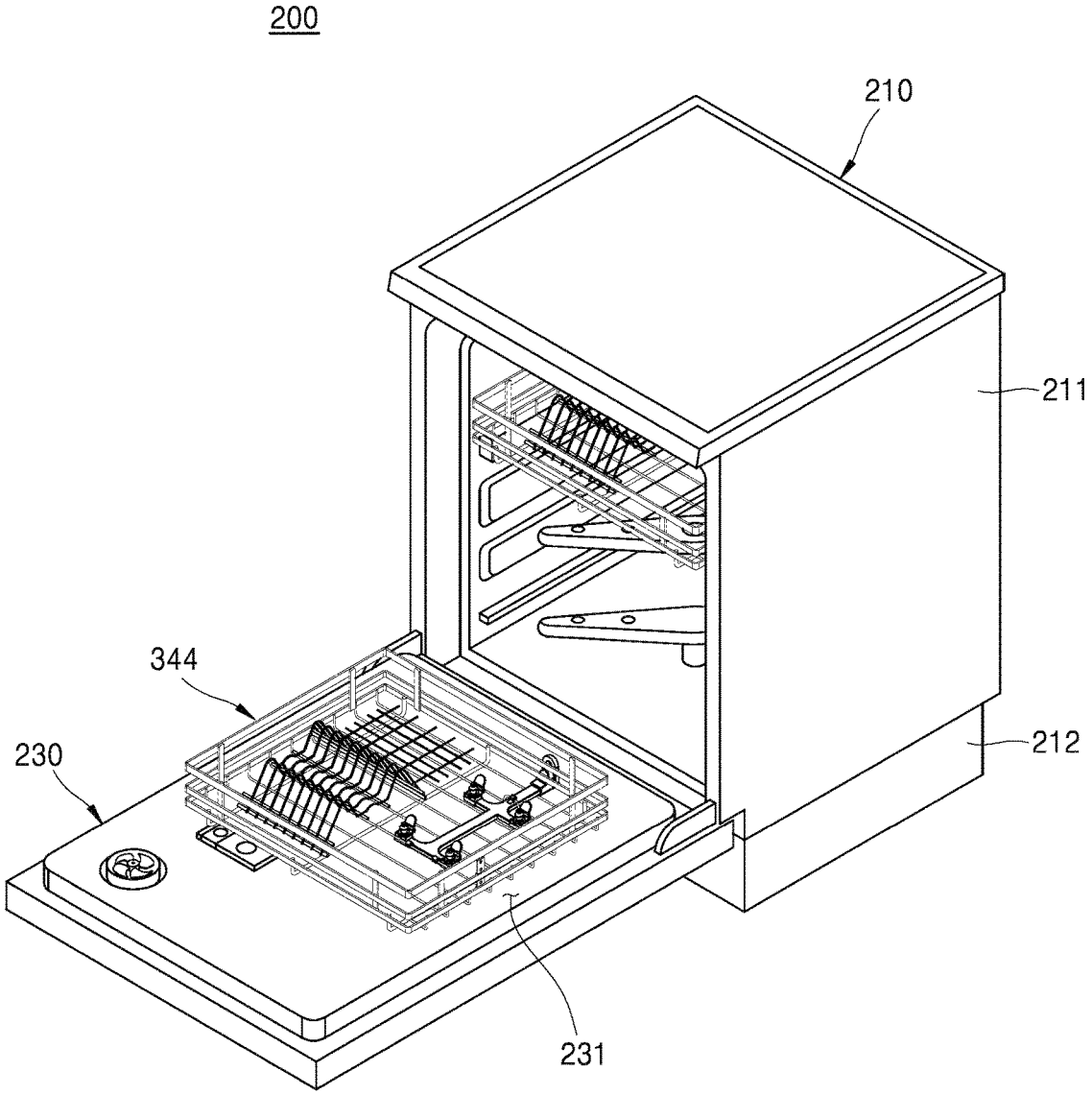
FIG. 3 is a perspective view showing the dishwasher with its door opened, which is seen from the right upper side, in one embodiment.
Figure 4:
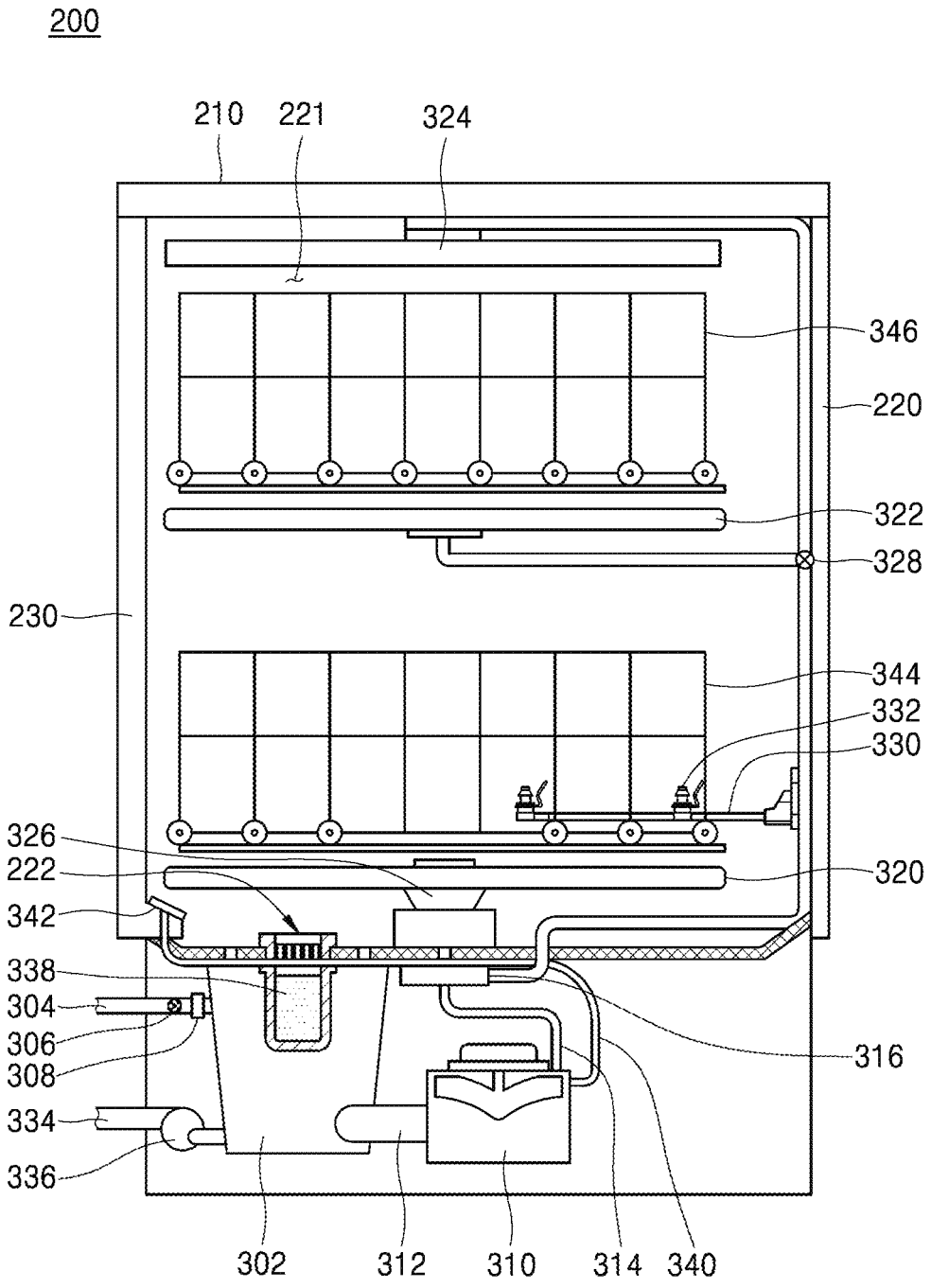
FIG. 4 is a cross-sectional view showing the dishwasher in one embodiment.

FIG. 2 is a perspective view showing a dishwasher in one embodiment, which is seen from a right upper side. FIG. 3 is a perspective view showing the dishwasher with its door opened, which is seen from the right upper side, in one embodiment. FIG. 4 is a cross-sectional view showing the dishwasher in one embodiment.

A basic structure of the dishwasher 200 is described with reference to FIGS. 2 to 4.

A case 210 may form an exterior of the dishwasher 200 and may be divided into an upper space 211 and a lower space 212.

A tub 220 may be disposed in the upper space 211 in the case 210. The tub 220 may be formed into a hexahedron a front surface of which is open. However, the tub 220 may have different shapes and the shape of the tub 220 may not be limited.

A washing space 221 in which an object (e.g., a dish, a bottle and the like) to be washed is accommodated may be formed in the tub 220. Additionally, a connection hole 222 through which wash water flows into a sump 302 may be formed at a bottom of the tub 220.

The tub 220 may be provided with a door 230 on the front surface thereof, and the door 221 may open and close the washing space 221. The door 230 may be opened and closed automatically or manually.

The sump 302 may be disposed on a lower side of the bottom of the tub 220, i.e., in the lower space 212 of the case 210. The sump 302 may store wash water and collect wash water having been used to wash an object to be washed.

The sump 302 may connect to a water supply channel 304 through which wash water supplied from an external water source flows. A water supply valve 306 may allow wash water supplied by the external water source through the water supply channel 304 to flow to the sump 302. When the water supply valve 306 is opened, the wash water supplied by the external water source may flow into the sump 302 through the water supply channel 304.

The water supply channel 304 may be provided with a flow meter 308. The flow meter 308 may measure a flow rate of wash water flowing to the sump 302.

A plurality of racks 344, 346 on which an object to be washed such as tableware, a bottle and the like is stored may be disposed in the washing space 221.

The plurality of racks 344, 346 may include a lower rack 344 in a lower portion of the washing space 221 and an upper rack 346 in an upper portion of the washing space 221. The lower rack 344 and the upper rack 346 may be spaced from each other in an up-down direction, and may be withdrawn to a front of the tub 220 in a sliding manner. A user may store an object to be washed on the lower rack 344 and the upper rack 346 withdrawn.

FIG. 3 shows an example in which the lower rack 344 of the plurality of racks 344, 346 is withdrawn to the front of the tub 220 and mounted onto a mounting surface 231 of the door 230.

A wash pump 310 may connect to the sump 302 through a water collection channel 312. The wash pump 310 may supply a plurality of spray arms 320, 322, 324 with the wash water stored in the sump 302. To this end, the wash pump 310 may be provided with a wash motor that generates a rotational force Though not illustrated in the drawing, a check valve may be disposed in the water collection channel 312, i.e., between the sump 302 and the wash pump 310. The check valve may be opened in a direction from the sump 302 to the wash pump 310. That is, the check valve may be opened such that wash water flows from the sump 302 to the wash pump 310 and closed such that the wash water does not flow to the wash pump 310 to the sump 302. In other words, when wash water flows as a result of driving of the wash pump 310, the check valve may be opened, and when wash water does not flow as a result of stop of the driving of the wash pump 310, the check valve may be closed. A lower portion of the check valve may be swiveled around an upper portion of the check valve and opened by flow pressure of wash water of the wash pump 310. For example, the check valve may be a solenoid valve that is opened and closed by an electronic signal.

When the wash pump 310 is driven, the wash water stored in the sump 302 may be introduced into the wash pump 310 through the water collection channel 312, and the introduced wash water may be delivered to a first diverting valve 316 through a wash water supply channel 314.

A second diverting valve 318 along with the first diverting valve 316 may selectively supply at least one of the plurality of spray arms 320, 322, 324 with the wash water delivered by the wash pump 310. That is, the diverting valves 316, 318 may selectively connect the wash pump 310 and at least one of the plurality of spray arms 320, 322, 324.

The plurality of spray arms 320, 322, 324 may spray wash water to the washing space 221. The plurality of spray arms 320, 322, 324 may include a lower spray arm 320, an upper spray arm 322, and a top spray arm 324 spaced from one another in the up-down direction.

The diverting valves 316, 318 may connect to a spray arm connection channel 326, 328 and supply the plurality spray arms 320, 322, 324 with wash water. The spray arm connection channel 326, 328 may include a lower spray arm connection channel 326 configured to supply wash water to the lower spray arm 320, and an upper spray arm connection channel 328 configured to supply wash water to the upper spray arm 322 and the top spray arm 324.

The upper spray arm connection channel 328 may be disposed on a wall of one side of the tub 200. Accordingly, the upper spray arm connection channel 328 is referred to as a "wall wash water guide. The wall wash water guide 328 is specifically described below.

The lower spray arm 320 may be disposed at a lowermost end of the washing space 221, and may spray wash water toward the lower rack 344 from a lower side to an upper side. The upper spray arm 322 may be disposed on an upper side of the lower spray arm 320 at a middle end of the washing space 221 and may spray wash water toward the upper rack 346 from the lower side to the upper side. The top spray arm 324 may be disposed at an uppermost end of the washing space 221 and may spray wash water from the upper side to the lower side.

A bottle wash water guide 330 may be disposed in the washing space 221. The bottle wash water guide 330 may be branched from the wall wash water guide 328. The bottle wash water guide 330 may be arranged horizontally in the washing space 221. For example, the bottle wash water guide 330 may be disposed near the lower rack 344 but not limited. The bottle wash water guide 330 may also be disposed near the upper rack 344 and disposed at various positions.

The bottle wash water guide 330 may supply a plurality of bottle nozzles 332 with wash water. The plurality of bottle nozzles 332 may spray wash water into an object to be washed such as a nursing bottle and the like, an inner space of which is hollow. Accordingly, the plurality of bottle nozzles 332 may spray wash water in an upward direction.

When N (integers of 2 or greater) numbers of bottle nozzles 332 are provided, a maximum of N numbers of bottles may be washed at the same time.

The bottle wash water guide 330 and the plurality of bottle nozzles 332 may constitute a single bottle wash part 330, 332. A structure of the bottle wash part 330, 332 is specifically described hereunder.

A drainage channel 334 may connect to the sump 302. The drainage channel 334 may deliver the wash water stored in the sump 302 to an outside of the dishwasher 200.

A drainage pump 336 may drain the wash water in the sump 302 through the drainage channel 334. The drainage pump 336 may include a drainage motor configured to generate a rotational force. When the drainage pump 336 is driven, the wash water stored in the sump 302 may be drained out of the case 210 through the drainage channel 334.

A filter 338 may be mounted onto the connection hole 222, and may filter contaminants from wash water moving from the washing space 221 to the sump 302.

Though not illustrated in the drawing, the dishwasher 200 may be further provided with a heater.

The heater may be coupled to a lower side of the wash pump 320 and may heat the wash water in the wash pump 320. When the wash pump 320 is driven, the heater may heat the wash water flowing in the wash pump 320 to generate hot water. The heater may generate steam by heating the wash water in the wash pump 320 while maintaining a water level of the wash water in the wash pump 320 at a predetermined level or above. Accordingly, the heater may generate steam by heating the wash water present in the wash pump 320 when the wash pump 320 is driven, or may generate steam by heating the wash water stored in the wash pump 320 when the driving of the wash pump 320 stops.

The hot water generated by the heater may spray into the tub 220 through at least one of the plurality of spray arms 320, 322, 324. The steam generated by the heater may flow through a steam hose 340 and may be discharged into the washing space 221 through a steam nozzle 342.

Though not illustrated in the drawing, the dishwasher 200 may further include a controller.

The controller may control driving of components in the dishwasher 200, and accordingly, may control operations of the dishwasher 200. The controller may be a processor-based device. The processor may include one or more of a central processing unit, an application processor or a communication processor.

[Structure of Wall Wash Water Guide]

Figure 5:
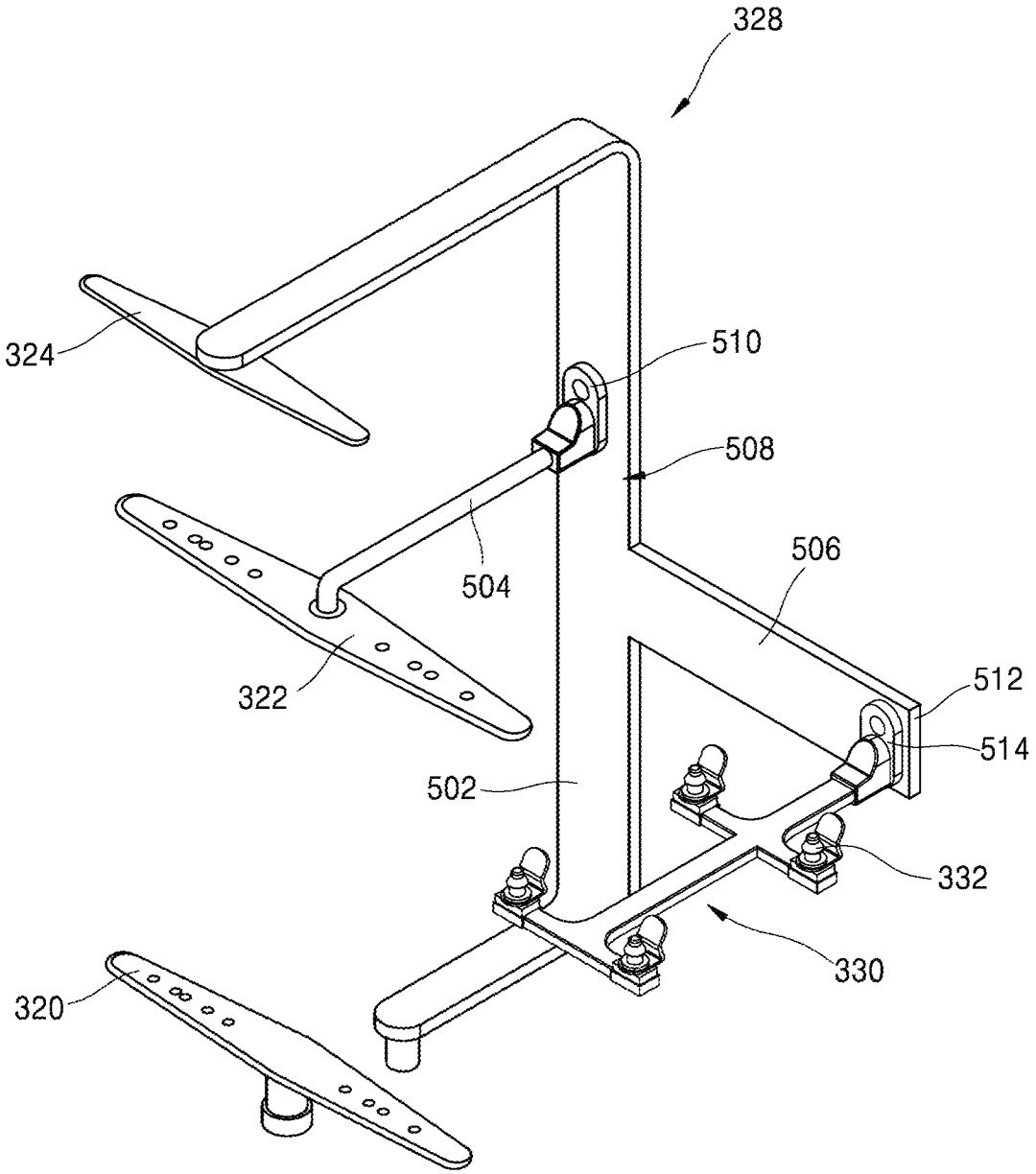
FIG. 5 is a view schematically showing a structure of a wall wash water guide in one embodiment.

FIG. 5 is a view schematically showing a structure of a wall wash water guide 328 in one embodiment.

Referring to FIG. 4, the wall wash water guide 328 may be arranged on an inner surface facing the door 230 among inner surfaces of the tub 220.

Referring to FIG. 5, the wall wash water guide 328 may include a main wall wash water guide 502, a first sub wall wash water guide 504 and a second sub wall wash water guide 506.

The main wall wash water guide 502 may be a main channel that allows the wash water stored in the sump 302 to move in the upward direction. The main wall wash water guide 502 may connect to one side of an upper surface of the sump 302 and may be formed as a result of extension along a wall of the tub 220 in the upward direction.

An upper portion of the main wall wash water guide 502 may be bent along an upper surface of the tub 220, and an end of a part of the main wall wash water guide 502 bent may connect to the top spray arm 324. The top spray arm 324 may spray wash water supplied by the part of the main wall wash water guide 502 bent to the washing space 221.

The first sub wall wash water guide 504 may be branched from a first point that is an approximately central portion of the main wall wash water guide 502. One end of the first sub wall wash water guide 504 may connect to the main wall wash water guide 502 and may be supplied with wash water moved from the main wall wash water guide 502. The other end of the first sub wall wash water guide 504 may connect to the upper spray arm 322, and the upper spray arm 322 may spray wash water moved from the first sub wall wash water guide 504 to the washing space 221.

A first guide supporter 508 and a first connector 510 may be arranged at a first point at which the main wall wash water guide 502 and the first sub wall wash water guide 504 connect. The first guide supporter 508 may be disposed on the main wall wash water guide 502, and the first connector 510 may be disposed at the first sub wall wash water guide 504. As a result of coupling of the first guide supporter 508 and the first connector 510, the main wall wash water guide 502 and the first sub wall wash water guide 504 may connect at the first point to allow wash water to move.

The second sub wall wash water guide 506 may be branched from a second point that is an approximately lower point of the main wall wash water guide 502. One end of the second sub wall wash water guide 506 may connect to the main wall wash water guide 502 and may be supplied with wash water moved from the main wall wash water guide 502. The other end of the second sub wall wash water guide 506 may connect to the bottle wash water guide 330. The bottle wash water guide 330 may be supplied with the wash water moved from the main wall wash water guide 502 and may supply the wash water received to the plurality of bottle nozzles 332. The plurality of bottle nozzles 332 may spray the wash water moved from the bottle wash water guide 330 to the washing space 221.

A second guide supporter 512 and a second connector 514 may be disposed at a third point where the second sub wall wash water guide 506 and the bottle wash water guide 330 connect. The second guide supporter 512 may be arranged on the second sub wall wash water guide 506, and the second connector 514 may be arranged at the bottle wash water guide 330. As a result of coupling between the second guide supporter 512 and the second connector 514, the second sub wall wash water guide 506 and the bottle wash water guide 330 may connect at the third point to allow wash water to move.

A flow of wash water in the wall wash water guide 328 and the bottle wash water guide 330 is described as follows.

Wash water stored in the sump 302 may be pumped by the wash pump 310, and the first diverting valve 316 may move the wash water to at least one of the lower spray arm connection channel 326 and the wall wash water guide 328. The wash water moved to the lower spray arm connection channel 326 may spray through the lower spray arm 320.

The main wall wash water guide 502 of the wall wash water guide 328 may move the wash water in the upward direction, and a portion of the wash water moved upward may be supplied to the top spray arm 324. The top spray arm 324 may spray the wash water supplied by the main wall wash water guide 502.

Another portion of the wash water moved upward through the main wall wash water guide 502 may be supplied to the first sub wall wash water guide 504 through the first guide supporter 508 and the first connector 510. The upper spray arm 322 may spray the wash water supplied to the first sub wall wash water guide 504.

The rest portion of the wash water moved upward through the main wall wash water guide 502 may move to the second sub wall wash water guide 506, and the rest portion moved may move to the bottle wash water guide 330 the second guide supporter 512 and the second connector 514. The plurality of bottle nozzles 332 may spray the wash water supplied to the bottle wash water guide 330.

Figure 15A:
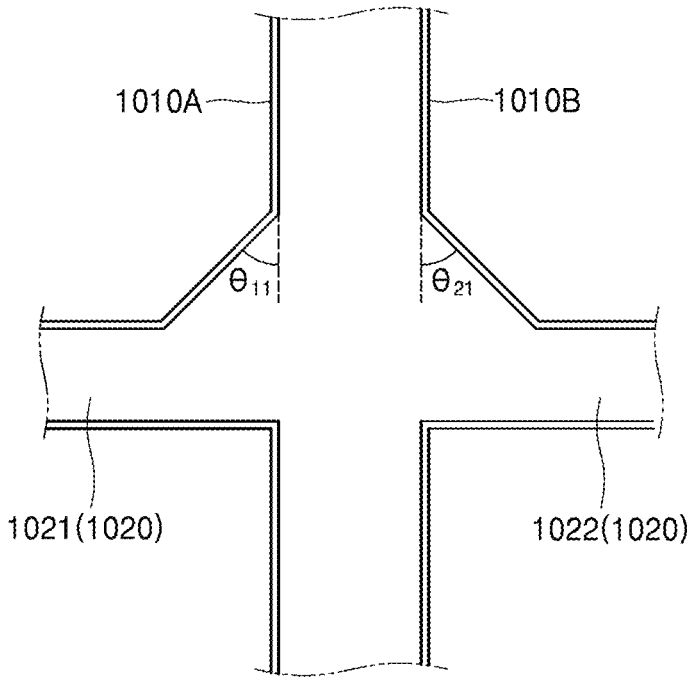
Figure 15B:
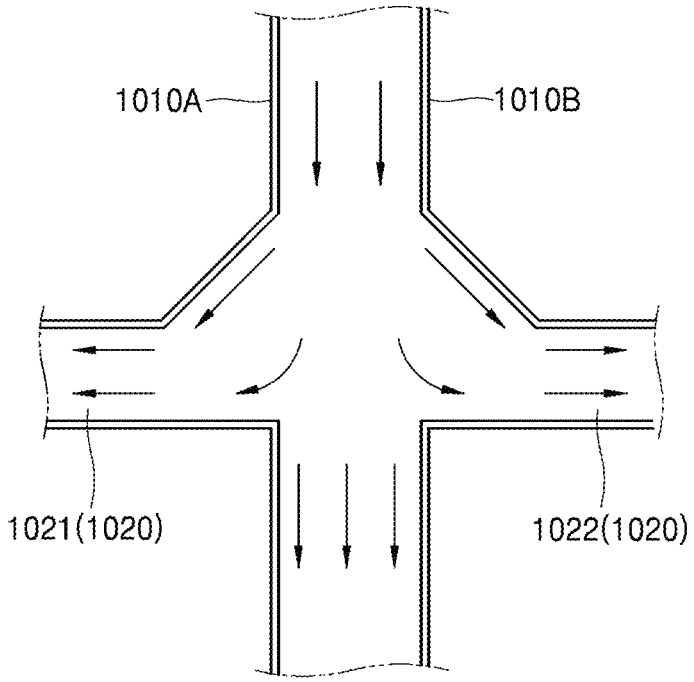

In FIGS. 15A and 15B the second sub wall wash water guide 506 is branched from a right side of the main wall wash water guide 502 but not limited. That is, the second sub wall wash water guide 506 may also be branched from a left side of the main wall wash water guide 502.

[Coupling Structure Between Second Sub Wall Wash Water Guide and Bottle Wash Water Guide]

Figure 6:
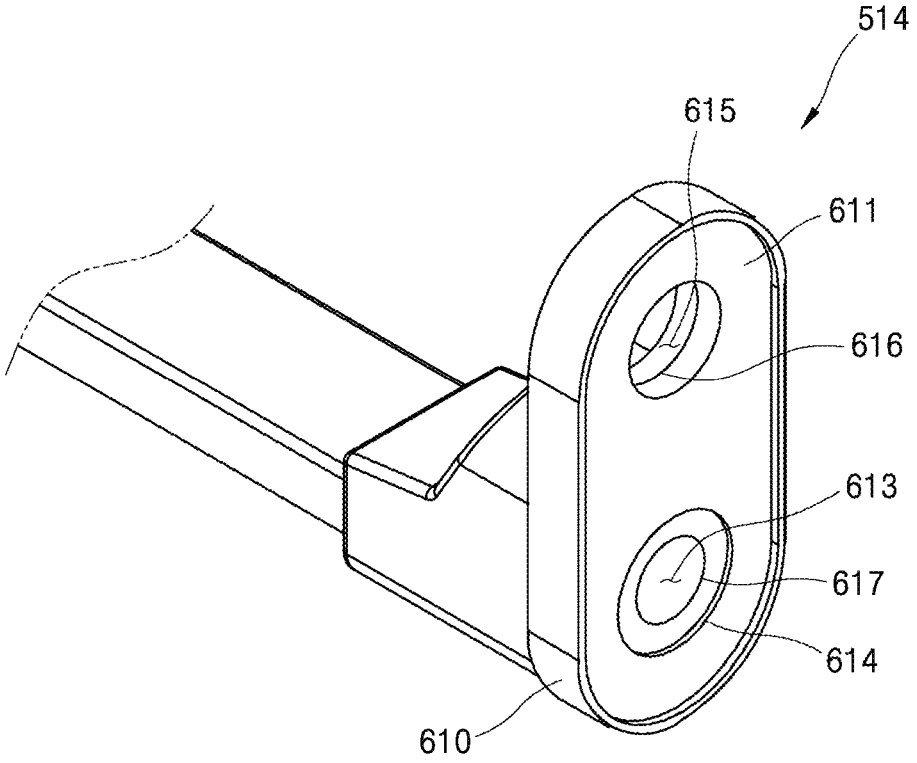
FIG. 6 is a view showing a structure of a second connector at an end of a bottle wash water guide, in one embodiment.
Figure 7:
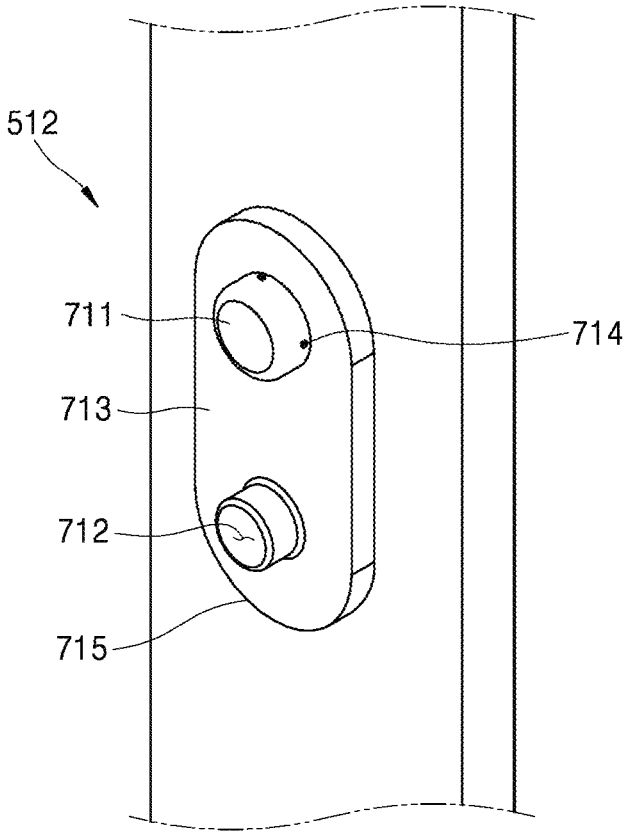
FIG. 7 wash water guide, in one embodiment.
Figure 8:
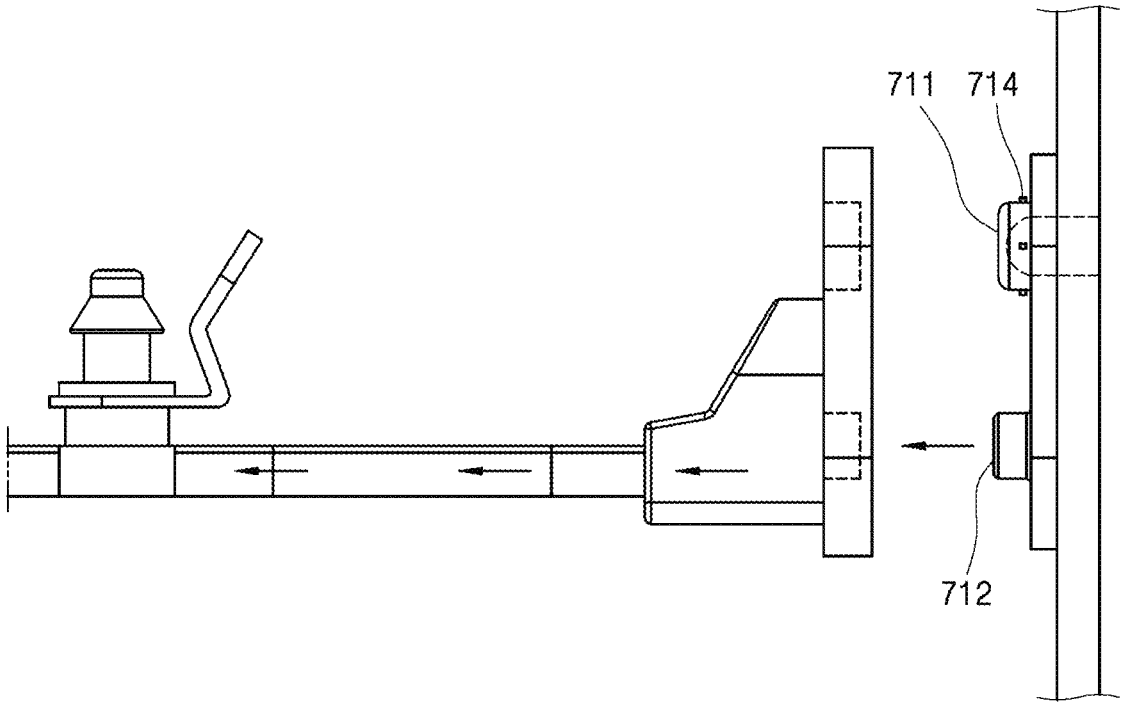
FIG. 8 is a view showing a structure in which the second connector and the second guide supporter are coupled, in one embodiment.

FIGS. 6 to 8 are views for describing a coupling structure between the second sub wall wash water guide 506 and the bottle wash water guide 330 in one embodiment.

Details provided with reference to FIGS. 6 to 8 may also be applied to a coupling structure between the main wall wash water guide 502 and the first sub wall wash water guide 504.

FIG. 6 is a view showing a structure of a second connector 514 at an end of a bottle wash water guide 330, in one embodiment. FIG. 7 is a view showing a structure of a second guide supporter 512 at an end of a second sub wall wash water guide 506, in one embodiment. FIG. 8 is a view showing a structure in which the second connector 514 and the second guide supporter 512 are coupled, in one embodiment.

Referring to FIG. 8, the second connector 514 according to the present disclosure may be attached to or detached from the second guide supporter 514. That is, when the lower rack 344 on which the bottle wash water guide 330 is disposed is in the tub 220, the second connector 514 and the second guide supporter 514 may be coupled, and when the lower rack 344 is withdrawn to the front of the tub 220, the second connector 514 and the second guide supporter 514 may be decoupled.

Referring to FIG. 6, the second connector 514 may include a front surface cover 611 connected to one end of the bottle wash water guide 330, and a rear surface cover 612 formed on a rear side of the front surface cover 611.

Specifically, a predetermined hole (not illustrated) may be formed in a lower portion of the front surface cover 611. The hole may be formed at a position corresponding to a position of a wash water inlet 613 formed in a lower portion of the rear surface cover 612. One end of the bottle wash water guide 330 may be inserted into and coupled to the hole. Accordingly, the wash water moved to the second connector 514 may be supplied to one end of the bottle wash water guide 330.

The rear surface cover 612 may be coupled to the front surface cover 611 from the rear side of the front surface cover 611, and the wash water inlet 613 and a detachment hole 615 may be formed at the rear surface cover 612.

The wash water inlet 613 may have a shape corresponding to a shape of an insertion part 715 (see FIG. 7) formed on the second guide supporter 512. To prevent leakage of wash water, a rubber member may be disposed on an inner circumferential surface of the wash water inlet 613.

A chamber 617 may be formed between the front surface cover 611 and the rear surface cover 617. The chamber 617 may help the wash water introduced through the wash water inlet 613 to move only to one end of the bottle wash water guide 330.

Additionally, a packing member 614, protruding to the rear of the rear surface cover 612 by a predetermined length, may be formed around the wash water inlet 613. When the insertion part 715 is inserted into the wash water inlet 613, the packing member 614 may prevent leakage of the wash water flowing through the wash water inlet 614 and a wash water outlet 712.

A hole having a predetermined diameter may be formed in an upper portion of the front surface cover 611 and an upper portion of the rear surface cover 612. Accordingly, the front surface cover 611 and the rear surface cover 612 may be coupled. Further, a detachment hole 615 allowing a protruding part 711 to be inserted may be formed on the second connector 512.

Referring to FIG. 7, the guide supporter 512 according to the present disclosure may include a protruding part 711, a wash water outlet 712, and a coupling surface 713.

The coupling surface 712 may closely contact the rear surface cover 612. The protruding part 711 may be formed at a predetermined position of the coupling surface 713 and may be inserted into the detachment hole 615. The wash water outlet 712 may be formed in a way that passes through the coupling surface 713, and the wash water flowing from the second sub wall wash water guide 506 may be discharged through the wash water outlet.

A through-shaped insertion part 715 extending by a predetermined length may be formed around the wash water outlet 712. The insertion part 715 may be inserted into the wash water inlet 613. Accordingly, the wash water flowing from the second sub wall wash water guide 506 may move to the bottle wash water guide 330. The insertion part 715 may have the same diameter as the wash water inlet 613 to prevent leakage of wash water or may have a diameter minutely smaller than the diameter of the wash water inlet 613 to ensure ease of attachment and detachment in a sliding manner.

The protruding part 711 may have the shape of a dome having a predetermined diameter. The diameter of the protruding part 711 may be the same as or minutely smaller than an inner diameter of the detachment hole 615.

One or more coupling projections 714 protruding by a predetermined length may be formed on an outer circumferential surface of the protruding part 711. The coupling projection 714 may prevent the bottle wash water guide 330 from being shaken backwards and forwards or form side to side when the bottle wash water guide 330 is coupled to the second sub wall wash water guide 506, and may allow the bottle wash water guide 330 to be coupled at a predetermined position of the guide supporter 512. That is, when the protruding part 711 is inserted into the detachment hole 615, the coupling projection 714 may be press-fitted to a coupling groove 616, and the second connector 514 may be firmly fixed to the guide supporter 512.

Referring to FIG. 8, the protruding part 711 of the guide supporter 512 may be inserted into the detachment hole 615 of the second connector 514. In this case, the coupling projection 714 formed on the outer circumferential surface of the protruding part 711 may pass an inner circumferential surface of the detachment hole 615 and then be mounted onto the coupling groove 616.

[Structure of Bottle Wash Water Guide]

A structure of a bottle wash water guide of the related art is first described hereunder, and a structure of a bottle wash water guide in an embodiment is described.

Referring to FIG. 1, a wash water guide 20 of the related art may include a main wash water guide 21, and a plurality of sub wash water guides 22.

The main wash water guide 21 may be a main channel for supplying wash water stored in a sump to a plurality of subsidiary nozzles 10.

The plurality of sub wash water guides 22 may be respectively branched from a plurality of points of the main wash water guide 21. One end of each of the plurality of sub wash water guides 22 may connect to the main wash water guide 21 to move wash water, and the other end of each of the plurality of sub wash water guides 22 may connect a corresponding subsidiary nozzle 10. The plurality of subsidiary nozzles 10 may spray wash water into a bottle.

The plurality of sub wash water guides 22 may be grouped into two or more pairs of sub wash water guides. FIG. 1 shows a wash water guide 20 including two pairs of sub wash water guides.

A pair of sub wash water guides may include a left sub wash water guide connected on a left side of the main wash water guide 21, and a right sub wash water guide connected on a right side of the main wash water guide 21. The left sub wash water guide and the right sub wash water guide may be disposed to face each other at a specific point. Two or more pairs of sub wash water guides may be spaced apart from each other with respect to a wash water inlet of the main wash water guide 21.

As illustrated in FIG. 1, the main wash water guide 21 may be disposed in a lengthwise direction, and each of the plurality of sub wash water guides 22 may be disposed in a widthwise direction and may cross the main wash water guide 21. In this case, a portion where the main wash water guide 21 and the sub wash water guide 22 connect may have a shape of a right angle (90°) not a rounded shape.

Figure 9:
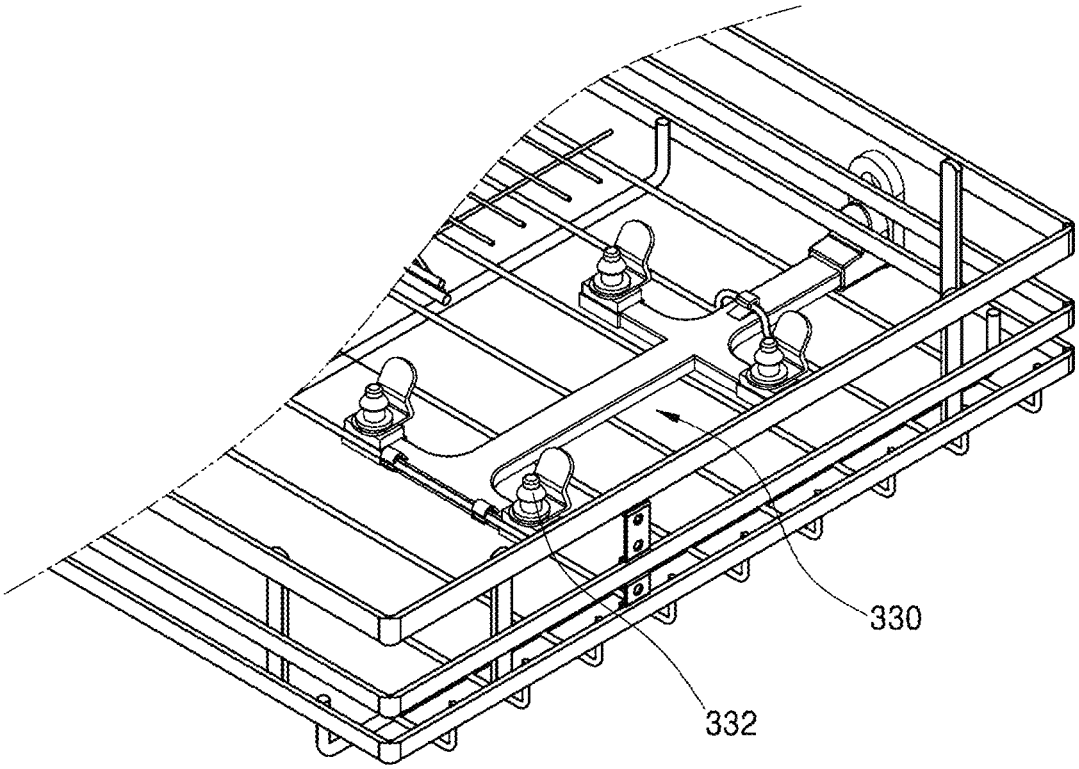
FIG. 9 is a perspective view showing a shape in which a bottle wash part in one embodiment is disposed.

Additionally, wash water in the main wash water guide 21 may move as indicated by the dashed line in FIG. 9. In other words, some of the wash water introduced into one end (i.e., the wash water inlet) of the main wash water guide 21 may move to the other end of the main wash water guide 21, and the remaining of the wash water introduced may move to the plurality of sub wash water guides 22.

The above-described structure of the wash water guide 20 may result in a difference in spray heights and spray pressures at which wash water sprays from each of the plurality of subsidiary nozzles 10.

That is, since the portion where the main wash water guide 21 and the sub wash water guide 22 connect is formed at an angle of 90°, a channel for allowing wash water to smoothly flow from the main wash water guide 21 to the sub wash water guide 22 may not be ensured. Due to the connected portion having an angle of 90°, wash water may not flow smoothly from the main wash water guide 21 to the sub wash water guide 22.

Additionally, a distance between the wash water inlet of the main wash water guide 21 and two or more pairs of sub wash water guides may differ. Accordingly, an amount of wash water introduced into the sub wash water guide 22 near the wash water inlet of the main wash water guide 21 may be greater than an amount of wash water introduced into the sub wash water guide 22 far from the wash water inlet of the main wash water guide 21.

Thus, a spray height or a spray pressure at which wash water sprays from each of the plurality of subsidiary nozzles 10 may differ, thereby causing deterioration of efficiency in which some of the plurality of subsidiary nozzles 10 wash a bottle.

According to the present disclosure, a structure of a wash water guide capable of solving the above problems may be provided.

FIG. 9 is a perspective view showing a shape in which a bottle wash part 330, 332 in one embodiment is disposed.

Referring to FIGS. 3, 4 and 9, the bottle wash part 330, 332 may be disposed on the lower rack 344.

The lower rack 344 may have the shape of a rectangular pillar an inner space of which is hollow, and an object to be washed may be disposed in an inner space of the lower rack 344.

In this case, the bottle wash part 330, 332 may be detachably disposed on a bottom surface of the lower rack 344. That is, the bottle wash part 330, 332 may be coupled onto the bottom surface of the lower rack 344 and may be decoupled by an external force applied by a user.

Additionally, to allow more objects to be washed to be arranged on the lower rack 344, the bottle wash part 330, 332 may be disposed in an edge portion of the lower rack 344.

FIGS. 3, 4 and 9 show the bottle wash part 330, 332 disposed on the lower rack 344. However, the bottle wash part 330, 332 may also be disposed on the upper rack 346. In this case, the above details may also be applied to the bottle wash part 330, 332 disposed on the upper rack 346.

Figure 10:
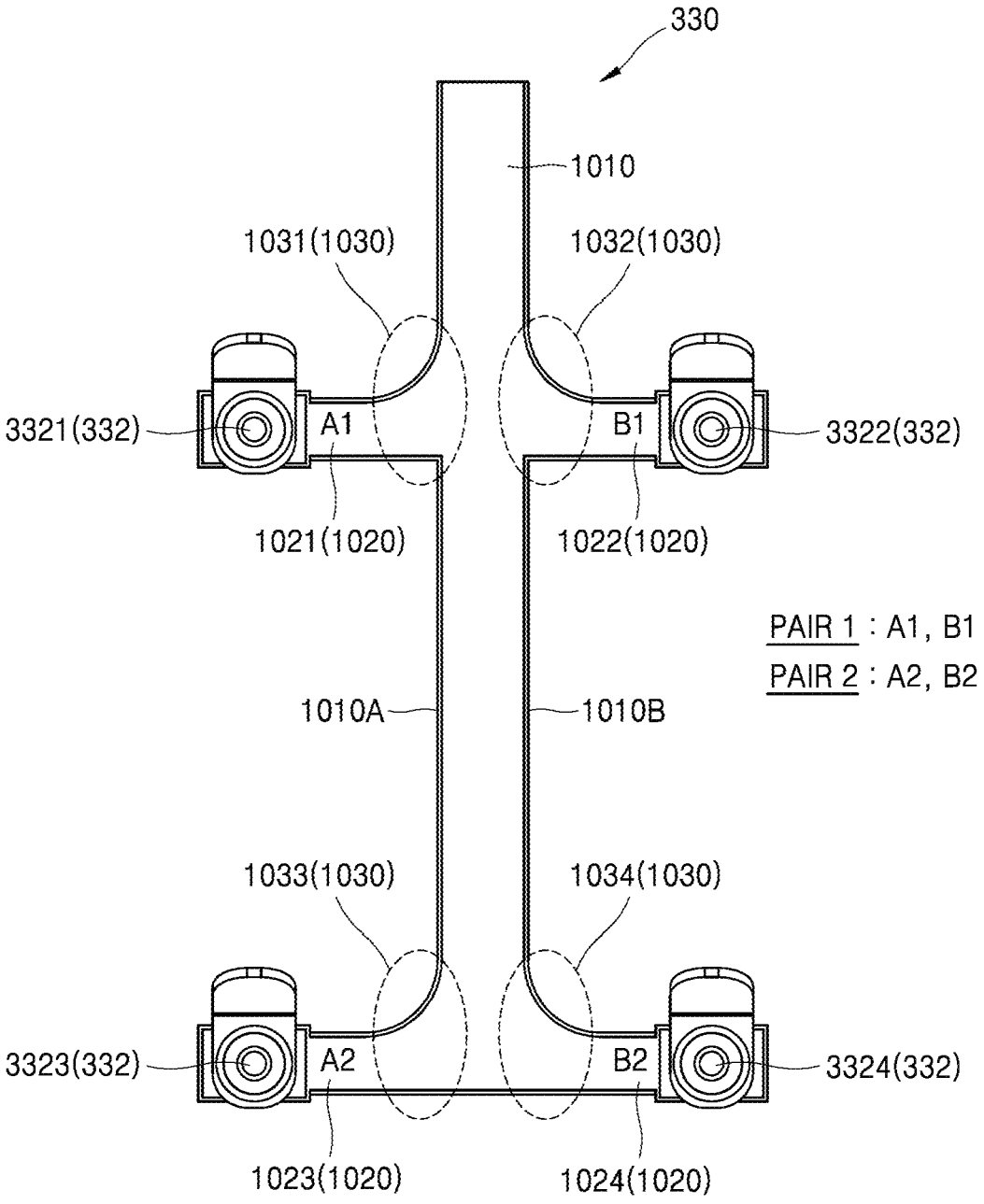
FIGS. 10, 11A, and 11B are plan views showing a bottle wash part in a first embodiment.

FIG. 10 is a plan view showing a bottle wash part 330, 332 in a first embodiment.

The bottle wash part 330, 332 in the first embodiment may have the same shape as the bottle wash part 330, 332 illustrated in FIGS. 3, 4 and 9.

Referring to FIG. 10, the bottle wash water guide 330 may include a main bottle wash water guide 1010, first to fourth sub bottle wash water guides 1021, 1022, 1023, 1024 included in a plurality of sub bottle wash water guides 1020, and first to fourth connection parts 1031, 1032, 1033, 1034 included in a plurality of connection parts 1030.

In FIG. 10, the plurality of sub bottle wash water guides 1020 includes four sub bottle wash water guides, and the plurality of connection parts 1030 includes four connection parts. However, the number of the sub bottle wash water guides and the number of the connection parts are not limited. The number of the plurality of sub bottle wash water guides 1020 and the number of the plurality of connection parts 1030 may vary. In this case, the number of the plurality of sub bottle wash water guides 1020 is the same as the number of the plurality of connection parts 1030, and the numbers may be 2 N (N denotes natural numbers.).

The main bottle wash water guide 1010 may be a main channel configured to supply wash water introduced from the second sub wall wash water guide 506 to the plurality of bottle nozzles 332. The main bottle wash water guide 1010 and the second sub wall wash water guide 506 connect as illustrated in FIG. 8. The main bottle wash water guide 1010 may have the shape of a cylinder, an oval pillar, a rectangular pillar and the like, an inner space of which is hollow.

One end, i.e., a wash water inlet, of the main bottle wash water guide 1010 may be open, and the wash water in the second sub wall wash water guide 506 may flow into the main bottle wash water guide 1010 through the wash water inlet. The other end, i.e., an end, of the main bottle wash water guide 1010 may be closed.

The main bottle wash water guide 1010 may be formed as a result of extension in a lengthwise direction of the bottle wash water guide 330. A length of the main bottle wash water guide 1010 may be determined based on the number of the plurality of bottle nozzles 332. That is, when the number of the plurality of bottle nozzles 332 is X (X denotes natural numbers of two or greater.), the main bottle wash water guide 1010 may have a first length, and when the number of the plurality of bottle nozzles 332 is Y (Y denotes natural numbers of two or greater and X or less.), the main bottle wash water guide 1010 may have a second length less than the first length.

For convenience of description, suppose that the main bottle wash water guide 1010 in the first embodiment has a uniform cross-sectional area. That is, suppose that the cross-sectional area of the main bottle wash water guide 1010 is the same in the overall shape of the main bottle wash water guide 1010. Herein, when the main bottle wash water guide 1010 has the shape of a cylinder, an oval pillar and a rectangular pillar, its cross-sectional area may be a diameter of the cylinder, a length of a long axis of the oval pillar, and a transverse length respectively.

Each of the plurality of sub bottle wash water guides 1020 may be a sub channel configured to supply the wash water introduced into the main bottle wash water guide 1010 to the plurality of bottle nozzles 332. Each of the plurality of sub bottle wash water guides 1020 may be branched from specific points of the main bottle wash water guide 1010. The sub bottle wash water guide 1020 may also have the shape of a cylinder, an oval pillar, a rectangular pillar and the like an inner space of which is hollow.

Each of the plurality of sub bottle wash water guides 1020 may be formed as a result of extension in a widthwise direction of the bottle wash water guide 330.

The plurality of sub bottle wash water guides 1020 may include a pair of first sub bottle wash water guides (PAIR 1) and a pair of second sub bottle wash water guides (PAIR 2). Each pair of sub bottle wash water guides (PAIR 1, PAIR 2) may include a sub bottle wash water guide A (i.e., a first sub wash water guide part) and a sub bottle wash water guide B (i.e., a second sub wash water guide part) that are disposed to face each other at a specific point. The pair of first sub bottle wash water guides (PAIR 1) may include a sub bottle wash water guide A1 disposed on a first lateral surface 1010A that is a left side of the main bottle wash water guide 1010, and a sub bottle wash water guide B1 disposed on a second lateral surface 1010B that is a right side of the main bottle wash water guide 1010. The pair of second sub bottle wash water guides (PAIR 2) may include a sub bottle wash water guide A2 disposed on the first lateral surface 1010A of the main bottle wash water guide 1010, and a sub bottle wash water guide B2 disposed on the second lateral surface 1010B of the main bottle wash water guide 1010. The pair of first sub bottle wash water guides (PAIR 1) and the pair of second sub bottle wash water guides (PAIR 2) may be spaced from each other with respect to the wash water inlet of the main bottle wash water guide 1010, and the pair of first sub bottle wash water guides (PAIR 1) may be disposed closer to the wash water inlet of the main bottle wash water guide 1010 than the pair of second sub bottle wash water guides (PAIR 2).

In summary, the pair of first sub bottle wash water guides (PAIR 1) may include a first sub bottle wash water guide 1021, i.e., the sub bottle wash water guide A1 and a second sub bottle wash water guide 1022, i.e., the sub bottle wash water guide B1, and the pair of second sub bottle wash water guides (PAIR 2) may include a third sub bottle wash water guide 1023, i.e., the sub bottle wash water guide A2 and a fourth sub bottle wash water guide 1024, i.e., the sub bottle wash water guide B2.

The plurality of bottle nozzles 332 includes a pair of first bottle nozzles and a pair of second bottle nozzles. Each pair of bottle nozzles includes a bottle nozzle A (i.e., a first nozzle) and a bottle nozzle B (i.e., a second nozzle). The bottle nozzle A corresponds to a first bottle nozzle 3321 and a third bottle nozzle 3323. The bottle nozzle B corresponds to a second bottle nozzle 3322 and a fourth bottle nozzle 3324. The bottle nozzle A is connected to the sub bottle washing water guide A 1021, 1023, and the bottle nozzle B is connected to the sub bottle washing water guide B 1022, 1024. A structure of each of the plurality of sub bottle wash water guides 1020 is described hereunder as follows. For convenience of description, a structure of the first sub bottle wash water guide 1021 among the plurality of sub bottle wash water guides 1020 is described, and the details provided hereunder may also be applied to the second to fourth sub bottle wash water guides 1022, 1023, 1024.

One end of the first sub bottle wash water guide 1021 may connect to a specific point of the first lateral surface 1010 A of the main bottle wash water guide 1010, and wash water in the main bottle wash water guide 1010 may flow into one end of the first sub bottle wash water guide 1021.

A first bottle nozzle 3321 among the plurality of bottle nozzles 332 may be arranged on an upper surface of the other end of the first sub bottle wash water guide 1021, and the rest surfaces except for the upper surface of the other end of the first sub bottle wash water guide 1021 may be closed. The first bottle nozzle 3321 may spray wash water introduced through the upper surface of the other end of the first sub bottle wash water guide 1021.

For convenience of description, suppose that the plurality of sub bottle wash water guides 1020 may have an identical and uniform cross-sectional area. That is, the cross-sectional area of the sub bottle wash water guide 1021, 1022, 1023, 1024 may be the same in the overall shape of the sub bottle wash water guide 1021, 1022, 1023, 1024, and the plurality of sub bottle wash water guides 1020 may have the same cross-sectional area. Herein, a cross-sectional area of the sub bottle wash water guide 1020 having the shape of a cylinder, an oval pillar and a rectangular pillar may be defined in the way describe above. Additionally, suppose that the plurality of sub bottle wash water guides 1020 has the same shape, cross-sectional area and length and that the plurality of bottle nozzles 332, connected to the other ends of the plurality of sub bottle wash water guides 1020, has the same size (i.e., a size of a hole in the bottle nozzle 332).

Each of the plurality of connection parts 1030 may connect the main bottle wash water guide 1010 and the plurality of sub bottle wash water guides 1020. That is, the plurality of connection parts 1030 may connect lateral surfaces of the main bottle wash water guide 1010 and lateral surfaces of the plurality of sub bottle wash water guides 1020 at specific points.

The plurality of connection parts 1030 may include a pair of first connection parts and a pair of second connection parts. The pair of connection parts may include a connection part A (i.e., a first connector) and a connection part B (i.e., a second connector) that are disposed to face each other at a specific point. The first connection part may include a connection part A1 configured to connect the first lateral surface 1010A of the main bottle wash water guide 1010 and the sub bottle wash water guide A1, and a connection part B1 configured to connect the second lateral surface 1010B of the main bottle wash water guide 1010 and the sub bottle wash water guide B. The second connection part may include a connection part A2 configured to connect the first lateral surface 1010 A of the main bottle wash water guide 1010 and the sub bottle wash water guide A2, and a connection part B2 configured to connect the second lateral surface 1010B of the main bottle wash water guide 1010 and the sub bottle wash water guide B2. The pair of first connection parts and the pair of second connection parts may be spaced from each other with respect to the wash water inlet of the main bottle wash water guide 1010, and the pair of first connection parts may be disposed closer to the wash water inlet of the main bottle wash water guide 1010 than the pair of second connection parts.

In summary, the pair of first connection parts may include a first connection part 1031, i.e., the connection part A1 and a second connection part 1032, i.e., the connection part B1, and the pair of second connection parts may include a third connection part 1033, i.e., the connection part A2 and a fourth connection part 1034, i.e., the connection part B2.

The connection part A1 and the connection part B1 may have shapes that are reversed left to right or not reversed left to right. Likewise, the connection part A2 and the connection part B2 may have shapes that are revered left to right or not revered left to right.

A structure of each of the plurality of connection parts 1030 is described as follows. For convenience of description, a structure of the first connection part 1031 among the plurality of connection parts 1030 is described, and the details provided hereunder may also be applied to the second to fourth connection parts 1032, 1033, 1034.

The first connection part 1031 may include a first sub connection part 1031 A and a second sub connection part 1031B. The first sub connection part 1031A may connect the first lateral surface 1010A of the main bottle wash water guide 1010 and a first lateral surface of the first sub bottle wash water guide 1021, and the second sub connection part 1031B may connect the first lateral surface 1010A of the main bottle wash water guide 1010 and a second lateral surface of the first sub bottle wash water guide 1021.

The first lateral surface of the first sub bottle wash water guide 1021 may be disposed closer to the wash water inlet of the main bottle wash water guide 1010 than the second lateral surface of the first sub bottle wash water guide 1021. Accordingly, the first sub connection part 1031A may be disposed closer to the wash water inlet of the main wash water guide 1010 than the second sub connection part 1031B.

The first sub connection part 1031A and the second sub connection part 1031B may have the same shape or may have a different shape. FIG. 10 shows the bottle wash water guide 330 including the first sub connection part 1031A and the second sub connection part 1031B that have a different shape.

Referring to FIG. 10, in the plan view, the plurality of connection parts 1030 may have a curved line shape. Specifically, the first sub connection part included respectively in the plurality of connection parts 1030 may have a curved line shape, and the second sub connection part included respectively in the plurality of connection parts 1030 may have a right angle shape or a horizontal line shape.

In a three-dimensional view of the shapes of the plurality of connection parts 1030, the "curved line shape" may correspond to a "curved surface shape", the "right angle shape" may correspond to "two surfaces connected at the right angle", and the "horizontal line shape" may correspond to a "single surface shape placed horizontally". For convenience of description, the shapes of the plurality of connection parts 1030 in the plan view are described.

Referring to FIG. 10, the first sub connection parts of the first connection part 1031, the second connection part 1032, the third connection part 1033 and the fourth connection part 1034 may have a curved line shape. That is, the first sub connection part may connect a lateral surface of the main bottle wash water guide 1010 and a first lateral surface of the sub bottle wash water guide 1021, 1022, 1023, 1024 in a curved line shape.

The curved line of the first sub connection part may be a line that is curved downward with respect to an inside of the bottle wash water guide 330 but not limited.

The second sub connection part of the first connection part 1031 may connect the second lateral surface of the first sub wash water guide 1021 and the lateral surface of the main wash water guide 1010 at an angle of 90°. That is, the first connection part 1031 may have a shape in which two lines cross. Likewise, the second sub connection part of the second connection part 1032 may connect a second lateral surface of the second sub wash water guide 1022 and the lateral surface of the main wash water guide 1010 at the right angle. The second sub connection part of the first connection part 1031 and the second sub connection part of the second connection part 1032 may have shapes that are reversed left to right.

Additionally, the second sub connection part of the third connection part 1033 may connect a second lateral surface of the third sub wash water guide 1023 and the lateral surface of the main wash water guide 1010 in a horizontal line shape. That is, the second sub connection part of the third connection part 1033 may extend from the second lateral surface of the third sub wash water guide 1023 to a direction in which the main wash water guide 1010 is disposed. Likewise, the second sub connection part of the fourth connection part 1034 may connect a second lateral surface of the fourth sub wash water guide 1024 and the lateral surface of the main wash water guide 1010 in a horizontal line shape. The second sub connection part of the third connection part 1033 and the second sub connection part of the fourth connection part 1034 may have shapes that are reversed left to right.

Figure 11A:
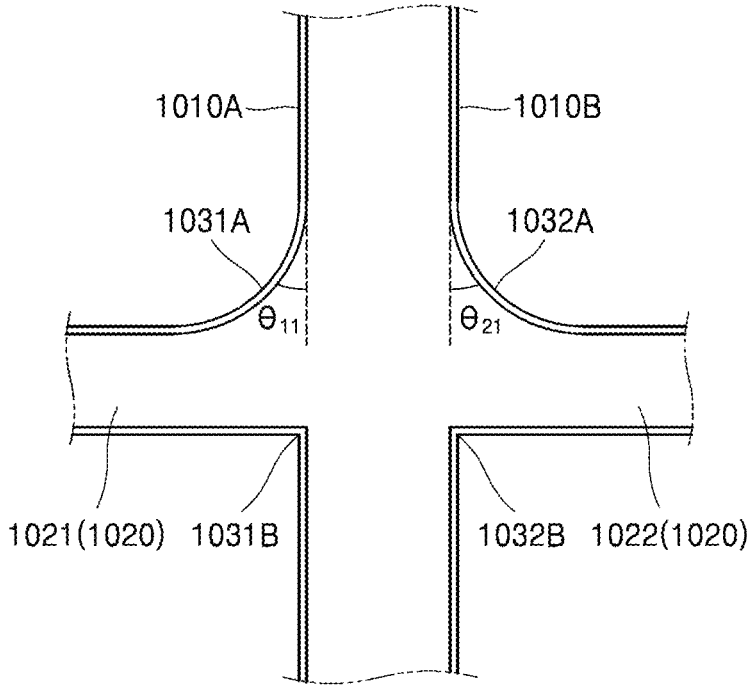
Figure 11B:
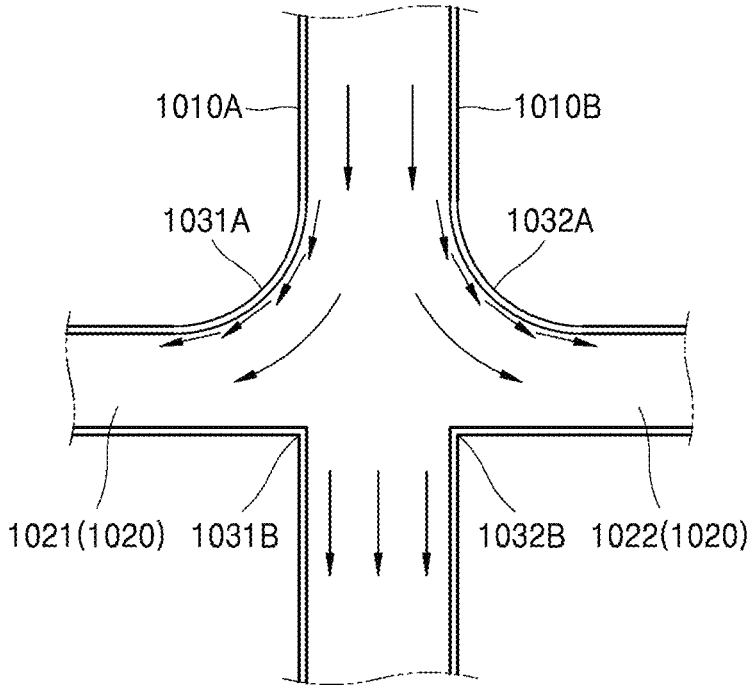

A structure of the curved line of the first sub connection part, and a flow of wash water in the bottle wash water guide 330 based on the structure are described hereunder with reference to FIGS. 11A and 11B.

FIGS. 11A and 11B shows a shape of the bottle wash water guide 330 including a pair of first connection parts. Details provided below may also be applied to a pair of second connection parts.

As mentioned above, the first sub connection part of the first connection part 1031 and the second sub connection part of the second connection part 1032 may have a curved line shape. In this case, the curved lines of the first sub connection part of the first connection part 1031 and the first sub connection part of the second connection part 1032 may have an identical curvature or a different curvature. FIGS. 11A and 11B shows an example in which the curved lines of the first sub connection part of the first connection part 1031 and the first sub connection part of the second connection part 1032 have the same curvature.

In FIG. 11A, the angles θ11, θ21 of the curved lines illustrated may be an angle between the connection part 1030 and the lateral surfaces of the main wash water guide 1010. The angle θ11, θ21 may relate to curvatures of the curved lines. That is, when two curved lines have the same curvature, the two curved lines may have the same angle. For example, FIGS. 11A and 11B shows two curved lines having the same curvature. Accordingly, the angle θ11 and the angle θ21 may be the same.

According to the present disclosure, the angle θ11 between the first sub connection part of the first connection part 1031 and the first lateral surface 1010A of the main wash water guide 1010, and the angle θ21 between the first sub connection part of the second connection part 1032 and the second lateral surface 1010B of the main wash water guide 1010 may be an acute angle.

Specifically, an angle between a virtual tangent formed at every point on the curved line and the lateral surface of the main wash water guide 1010 may all be an acute angle. Accordingly, the angle between the curved line and the lateral surface of the main wash water guide 1010 may be defined as an acute angle.

In summary, the first sub connection part of the first connection part 1031 and the first sub connection part of the second connection part 1032 may have a curved line shape, and the angle θ11 and the angle θ21 may be set to an acute angle. Accordingly, wash water moving in the main wash water guide 1010 may flow to the first sub wash water guide 1021 and the second sub wash water guide 1022 smoothly, as illustrated in FIG. 11B.

Briefly, with the curved line structure of the connection part 1030 described above, a spray height and a spray pressure of wash water spraying from the plurality of bottle nozzles 332 connected to the other ends of the plurality of sub bottle wash water guides 1020, may be uniformly controlled.

That is, height of the wash water spraying from the plurality of bottle nozzles 332 and an amount of wash water spraying from a single bottle nozzle 332 may be uniformized based on the curved line structure of the connection part 1030. Additionally, a reduction in the flow rate of wash water and a loss of energy, caused by the division of the wash water from the main wash water guide to each of the plurality of sub wash water guides, may be prevented.

When the plurality of connection parts 1030 are all disposed in a right angle shape, wash water may not smoothly flow from the main bottle wash water guide 1010 to each of the plurality of sub bottle wash water guides 1020. That is, the right angle shapes of the plurality of connection parts 1030 may serve as resistance against a wash water flow, thereby causing a non-uniform wash water flow. Thus, a channel of wash water may be first formed in any one of the plurality of sub bottle wash water guides 1020, and a spray height of a bottle nozzle 332 connected to any one sub bottle wash water guide 1020 may increase while a spray height of a bottle nozzle 332 connected to the other of the plurality of sub bottle wash water guides 1020 may decrease. Additionally, the right angle-shaped connection part 1030 may cause a lack of uniformity in the spray height of the wash water spraying from a single bottle nozzle 332 with time.

However, according to the present disclosure, the first sub connection parts included respectively in the plurality of connection parts 1030 may have a curved line shape. Accordingly, wash water may flow from the main bottle wash water guide 1010 into each of the plurality of sub bottle wash water guides 1020 smoothly, and a flow rate of the wash water may increase. Thus, the spray height of the plurality of bottle nozzles 332 connected to the plurality of sub bottle wash water guides 1020 may be uniformized, and the spray height of wash water of each of the plurality of bottle nozzles 332 may be uniformized with time. Further, a reduction in the flow rate of wash water and a loss of energy, caused by the division of the wash water from the main wash water guide to each of the plurality of sub wash water guides, may be prevented.

As described above, the curved lines of the plurality of connection parts 1030 may have an identical curvature or a different curvature. As a result of setting of the curvature of the curved line, wash water spraying from the plurality of nozzles 332 may spray at a uniform spray height.

The curvature of the curved line of each of the plurality of connection parts 1030 may be set based on at least one of the positions at which the plurality of connection parts 1030 are disposed with respect to the wash water inlet of the main wash water guide 1010, the cross-sectional areas of the plurality of sub bottle wash water guides 1020 and the sizes of the plurality of nozzles 332. However, suppose that the cross-sectional area of the main bottle wash water guide 1010 is uniformized.

Description of the setting of the curvature of the curved line of each pair of connection parts is provided hereunder.

In one embodiment, when the cross-sectional area of the sub bottle wash water guide A and the cross-sectional area of the sub bottle wash water guide B are the same and a size of a bottle nozzle A and a size of a bottle nozzle B are the same, the curvature of the curved line of the connection part A and the curvature of the curved line of the connection part B may be the same.

That is, when the cross-sectional area of the sub bottle wash water guide A and the cross-sectional area of the sub bottle wash water guide B are the same and the size of the bottle nozzle A and the size of the bottle nozzle B are the same, the curvature of the curved line of the connection part A and the curvature of the curved line of the connection part B need to be the same, such that a flow rate of wash water flowing into the sub bottle wash water guide A and a flow rate of wash water flowing into the sub bottle wash water guide B become identical. As a result, the spray height of the wash water spraying to the plurality of bottle nozzles 332 may become identical.

In another embodiment, when the cross-sectional area of the sub bottle wash water guide A and the cross-sectional area of the sub bottle wash water guide B are the same and the size of the bottle nozzle A is greater than the size of the bottle nozzle B, the curvature of the curved line of the connection part A may be greater than the curvature of the curved line of the connection part B.

That is, when the cross-sectional area of the sub bottle wash water guide A and the cross-sectional area of the sub bottle wash water guide B are the same and the curvature of the curved line of the connection part A and the curvature of the curved line of the connection part B are the same, a flow rate of wash water flowing into the sub bottle wash water guide A may be the same as a flow rate of wash water flowing into the sub bottle wash water guide B. However, since the size of the bottle nozzle A is greater than the size of the bottle nozzle B, a spray height of wash water of the bottle nozzle A may be less than a spray height of wash water of the bottle nozzle B.

To make the wash water spray height of the bottle nozzle A equal to the wash water spray height of the bottle nozzle B, a higher flow rate of wash water needs to flow into the sub bottle wash water guide A. To this end, the curvature of the curved line of the connection part A needs to be greater than the curvature of the curved line of the connection part B.

In yet another embodiment, when the size of the bottle nozzle A is the same as the size of the bottle nozzle B and the cross-sectional area of the sub bottle wash water guide A is greater than the cross-sectional area of the sub bottle wash water guide B, the curvature of the curved line of the connection part A may be less than the curvature of the curved line of the connection part B.

That is, when the size of the bottle nozzle A is the same as the size of the bottle nozzle B but the cross-sectional area of the sub bottle wash water guide A is greater than the cross-sectional area of the sub bottle wash water guide B, a larger amount of wash water may flow into the sub bottle wash water guide A. Accordingly, a spray pressure of the bottle nozzle A may be greater than a spray pressure of the bottle nozzle B, and the spray height at which wash water sprays from the bottle nozzle A may become greater than the spray height at which wash water sprays from the bottle nozzle B.

Accordingly, to make the wash water spray height of the bottle nozzle A equal to the wash water spray height of the bottle nozzle B, a higher rate of wash water needs to flow into the sub bottle wash water guide B. To this end, the curvature of the curved line of the connection part B needs to be greater than the curvature of the curved line of the connection part A.

To put it simply, a flow rate of wash water flowing into the sub bottle wash water guides A and B is an important factor to allow the bottle nozzles A and B to spay wash water at the same spray height, and the curvatures of the curved lines of the connection parts A and B may be set based on the sizes of the bottle nozzles A and B and the cross-sectional areas of the sub bottle wash water guides A and B. In this case, the curvatures of the curved lines of the connection parts A and B may be proportional to the sizes of the nozzles A and B, and may be inversely proportional to the cross-sectional areas of the sub bottle wash water guides A and B.

Description of the setting of the curvatures of the curved lines of the pair of first connection parts and the pair of second connection parts is provided hereunder. For convenience of description, suppose that the curvatures of the curved lines of the connection parts A and B included in the pair of first connection parts are the same and that the curvatures of the curved lines of the connection parts A and B included in the pair of second connection parts are the same. Additionally, suppose that the cross-sectional areas of the plurality of sub bottle wash water guides 1020 are the same and that the sizes of the plurality of bottle nozzles 332 are the same.

In one embodiment, the curvature of the curved line of the pair of first connection parts and the curvature of the curved line of the pair of second connection parts may differ. That is, the pair of first connection parts may be disposed closer to the wash water inlet of the main wash water guide 1010 than the pair of second connection parts. According to the present disclosure, the curvature of the curved line may be set based on the position of each pair of connection parts.

Specifically, some of the wash water moving into the main wash water guide 1010 may flow to the first sub bottle wash water guide 1021 and the second sub bottle wash water guide 1022 that are primarily branched from the main wash water guide 1010. In this case, when the curvature of the curved line of the pair of first connection parts is the same as the curvature of the curved line of the pair of second connection parts, a flow rate of wash water flowing into the third sub bottle wash water guide 1023 and the fourth sub bottle wash water guide 1024 connected to the pair of second connection parts may be less than a flow rate of wash water flowing into the first sub bottle wash water guide 1021 and the second sub bottle wash water guide 1022. As a result, a spray height of wash water spraying to a third bottle nozzle 3223 and a fourth bottle nozzle 3224 may be less than a spray height of wash water spraying to a first bottle nozzle 3221 and a second bottle nozzle 3222.

To prevent this from happening, according to the present disclosure, the curvature of the curved line of the pair of second connection parts may be set to a curvature greater than the curvature of the curved line of the pair of first connection parts. A large curvature of the curved line may lead to an increase in the flow rate of wash water since the wash water easily moves to the sub bottle wash water guide. As a result, a spray pressure and a spray height of wash water spraying from the plurality of bottle nozzles 332 may become identical.

Briefly, according to the present disclosure, to spray wash water spraying from the plurality of nozzles 322 at the uniform spray height, the shape of the plurality of connection parts 1030 may be configured. The plurality of connection parts 1030 may connect to the main bottle wash water guide 1010 and the plurality of sub bottle wash water guides 1020 in a curved line shape. The curvatures of the curved lines of the plurality of connection parts 1030 may be set based on at least one of the positions at which the plurality of connection parts 1030 are disposed with respect to the wash water inlet of the main wash water guide 1010, the cross-sectional areas of the plurality of sub bottle wash water guides 1020 and the sizes of the plurality of nozzles 332.

FIG. 10 shows that all the plurality of connection parts 1030 have a curved line shape. However, the plurality of connection parts 1030 in FIG. 10 is provided only as an example. Some of the plurality of connection parts 1030 may have a curved line shape while the rest may have a right angle shape or a horizontal line shape. For example, the pair of first connection parts may have a curved line shape, and the pair of second connection parts may have a right angle shape or a horizontal line shape as in the related art.

Figure 12A:
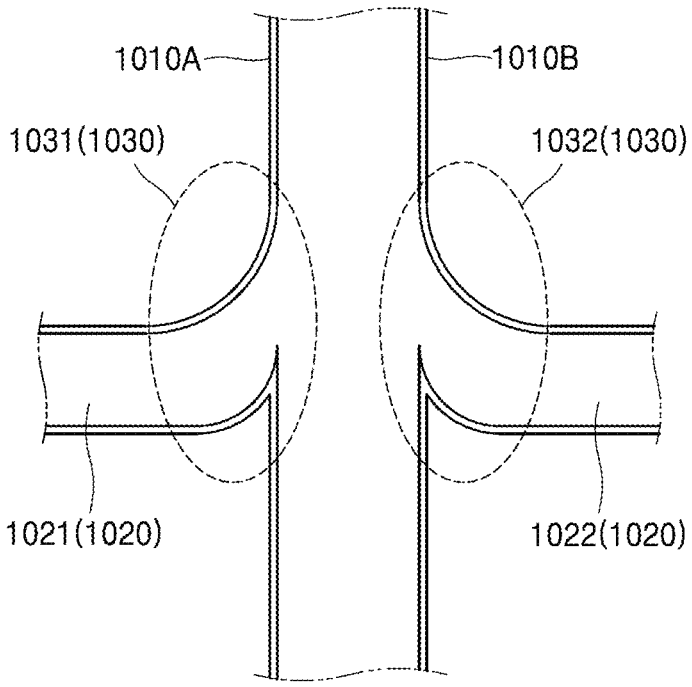
FIGS. 12A and 12B are plan views showing a bottle wash part in a second embodiment.
Figure 12B:
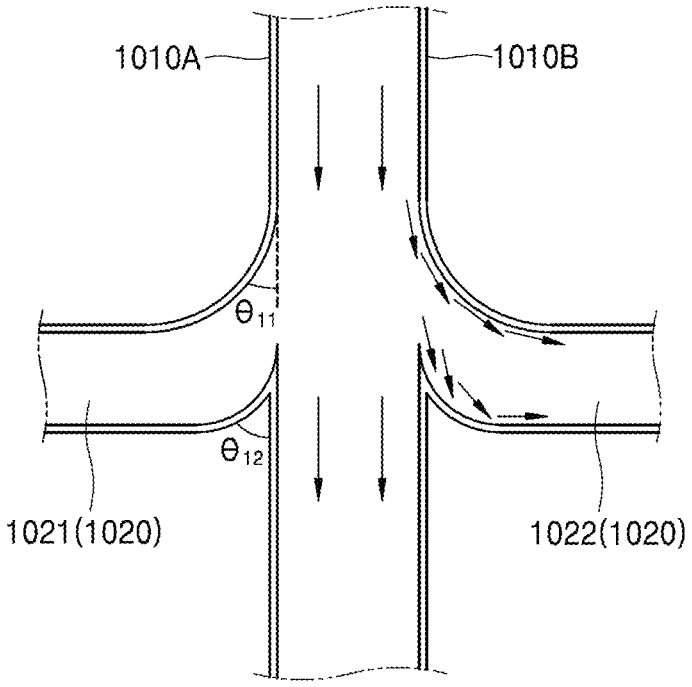

FIGS. 12A and 12B are plan views showing a part of a bottle wash part 330, 332 in a second embodiment.

That is, FIGS. 12A and 12B shows another embodiment of the pair of first connection parts.

Referring to FIGS. 12A and 12B, the pair of first connection parts may include a connection part A1 and a connection part B1, and a first sub connection part and a second sub connection part included in the connection part A1 may all have a curved line shape, and a first sub connection part and a second sub connection part included in the connection part B1 may all have a curved line shape.

Specifically, the first sub connection part of the connection part A1 may connect the first lateral surface 1010A of the main bottle wash water guide 1010 and a first lateral surface of the sub bottle wash water guide A in a curved line shape, and the first sub connection part of the connection part B1 may connect the second lateral surface 1010B of the main bottle wash water guide 1010 and a first lateral surface of the sub bottle wash water guide B in a curved line shape. Details in relation to this are the same as those provided above with reference to FIGS. 10 through 11B. Accordingly, detailed description in relation to this is omitted.

The second sub connection part of the connection part A1 may connect the first lateral surface 1010A of the main bottle wash water guide 1010 and a second lateral surface of the sub bottle wash water guide A in a curved line shape, and the second sub connection part of the connection part B1 may connect the second lateral surface 1010B of the main bottle wash water guide 1010 and a second lateral surface of the sub bottle wash water guide B in a curved line shape.

The curved line of the second sub connection part may be a line that is curved downward with respect to an outside of the bottle wash water guide 330 but not limited. In an example of FIGS. 11A and 11B, the second sub connection part of the connection part A1 and the second sub connection part of the connection part B1 may have shapes in which curvatures of the curved lines are the same and which are reversed left to right.

According to the present disclosure, an angle θ12 between the second sub connection part of the connection part A1 and the first lateral surface 1010A of the main wash water guide 1010 may be an acute angle. The angle θ12 may be defined as described with reference to FIGS. 11A and 11B.

The curved line of the first sub connection part of the connection part A1 and the curved line of the second sub connection part of the connection part A1 may have the same curvature or a different curvature. In this case, to readily manufacture of the bottle wash water guide 330, the curvature of the curved line of the first sub connection part of the connection part A1 and the curvature of the curved line of the second sub connection part of the connection part A1 may be set to the same value.

Likewise, the curved line of the first sub connection part of the connection part B1 and the curved line of the second sub connection part of the connection part B1 may have the same curvature or a different curvature. In this case, to readily manufacture of the bottle wash water guide 330, the curvature of the curved line of the first sub connection part of the connection part B1 and the curvature of the curved line of the second sub connection part of the connection part B1 may be set to the same value.

Additionally, the curved line of the second sub connection part of the connection part A1 and the curved line of the second sub connection part of the connection part B1 may have an identical curvature or a different curvature. In an example of FIGS. 11A and 11B, the curved line of the second sub connection part of the connection part A1 and the curved line of the second sub connection part of the connection part B1 have the same curvature. Details in relation to this are similar to the details on the setting of the curvature of the curved line, which are provided above with reference to FIG. 10. Accordingly, detailed description in relation to this is omitted.

In summary, the first and second sub connection parts of the connection parts A1 and B1 included in the pair of first connection parts may all have a curved line shape, and an angle of the curved line may be an acute angle. Since the second sub connection parts of the connection parts A1 and B1 have a curved line shape, wash water may flow from the main bottle wash water guide 1010 to the sub bottle wash water guides (1021, 1022) more smoothly.

Figure 13A:
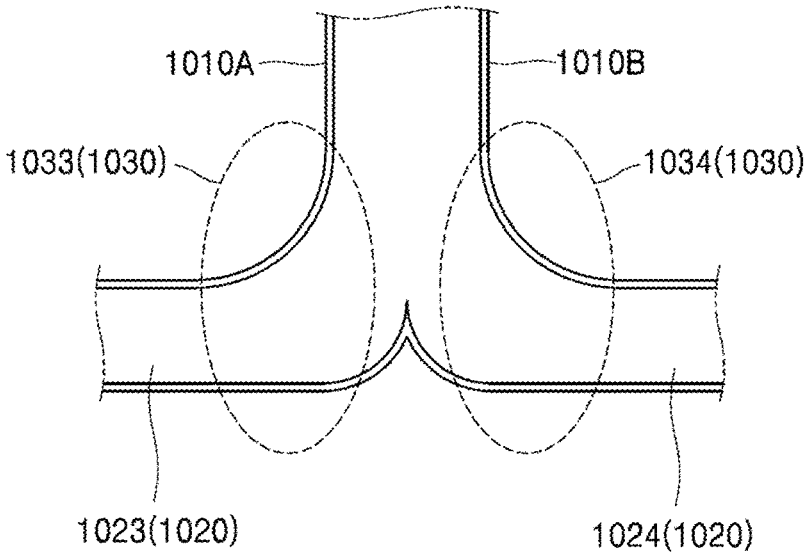
FIGS. 13A and 13B are plan views showing a bottle wash part in a third embodiment.
Figure 13B:
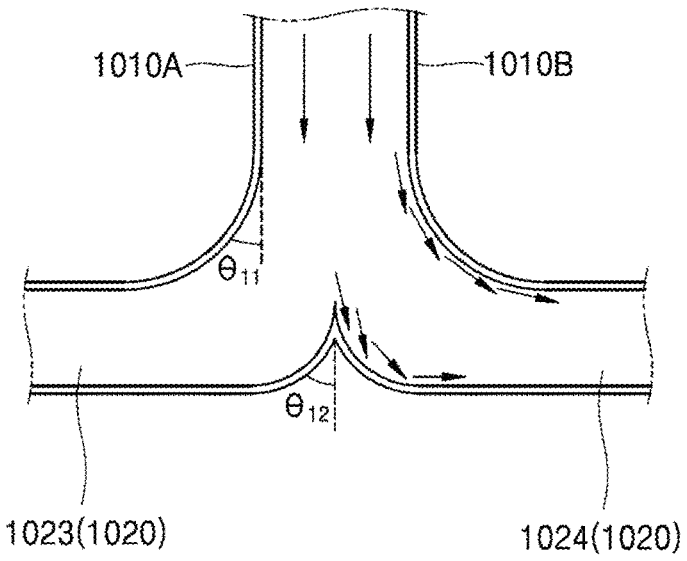

FIGS. 13A through 13B are plan views showing a part of a bottle wash part 330, 332 in a third embodiment.

That is, FIGS. 13A and 13B shows another embodiment of the pair of second connection parts.

Referring to FIGS. 13A and 13B, the pair of second connection parts may include a connection part A2 and a connection part B2, and a first sub connection part and a second sub connection part included in the connection part A2 may all have a curved line shape, and a first sub connection part and a second sub connection part included in the connection part B2 may all have a curved line shape.

Specifically, the first sub connection part of the connection part A2 may connect the first lateral surface 1010A of the main bottle wash water guide 1010 and the first lateral surface of the sub bottle wash water guide A in a curved line shape, and the first sub connection part of the connection part B2 may connect the second lateral surface 1010B of the main bottle wash water guide 1010 and the first lateral surface of the sub bottle wash water guide B in a curved line shape. Details in relation to this are the same as those provided above with reference to FIGS. 10 and 11. Accordingly, detailed description in relation to this is omitted.

The second sub connection part of the connection part A2 may connect a virtual central line in the main bottle wash water guide 1010 and the second lateral surface of the sub bottle wash water guide A in a curved line shape, and the second sub connection part of the connection part B2 may connect the virtual central line in the main bottle wash water guide 1010 and the second lateral surface of the sub bottle wash water guide B in a curved line shape.

The virtual central line in the main bottle wash water guide 1010 may correspond to a central portion of an end of the main bottle wash water guide 1010. With respect to the central portion of the end of the main bottle wash water guide 1010, a first direction may be an inward direction of the main bottle wash water guide 1010, and with respect to the central portion of the main bottle wash water guide 1010, a second direction may be an outward direction of the main bottle wash water guide 1010.

The curved line of the second sub connection part may be a line that is curved downward with respect to the outside of the bottle wash water guide 330, but not limited. The second sub connection part of the connection part A2 and the second sub connection pat of the connection part B2 may have shapes that are reversed left to right except for the curvatures of the curved lines.

According to the present disclosure, an angle θ12 between the first sub connection part of the connection part A2 and the virtual central line in the main wash water guide 1010 may be an acute angle. The angle θ12 may be defined as described above with reference to FIGS. 11A and 11B.

The curved line of the first sub connection part of the connection part A2 and the curved line of the second sub connection part of the connection part A2 may have the same curvature or a different curvature. Additionally, the curved line of the first sub connection part of the connection part B2 and the curved line of the second sub connection part of the connection part B2 may have the same curvature or a different curvature. For convenience of description, suppose that the curvature of the curved line of the first sub connection part of the connection part A2 and the curvature of the curved line of the second sub connection part of the connection part A2 are set to the same value.

Additionally, the curved line of the second sub connection part of the connection part A2 and the curved line of the second sub connection part of the connection part B2 may have an identical curvature or a different curvature. In an example of FIGS. 11A and 11B, the curved line of the second sub connection part of the connection part A1 and the curved line of the second sub connection part of the connection part B1 have the same curvature. Details in relation to this are similar to the details on the setting of the curvature of the curved line, which are provided above with reference to FIGS. 10 through 11B. Accordingly, detailed description in relation to this is omitted.

In summary, the first and second sub connection parts of the connection parts A2 and B2 included in the pair of second connection parts may all have a curved line shape, and an angle of the curved line may be an acute angle. Since the second sub connection parts of the connection parts A2 and B2 have a curved line shape, wash water may flow from the main bottle wash water guide 1010 to the sub bottle wash water guides A and B more smoothly.

Figure 14:
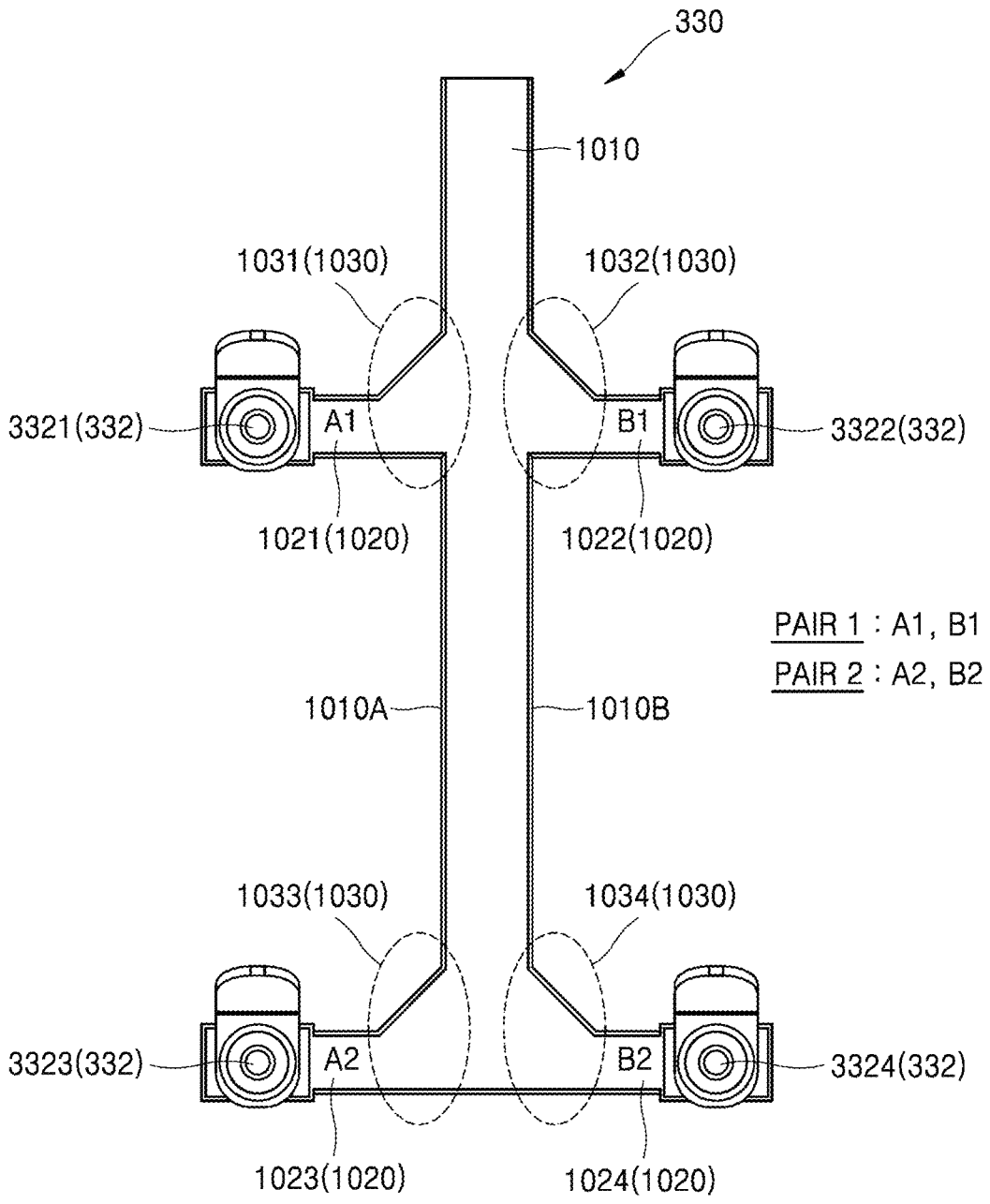
FIGS. 14 through 15B are plan views showing a bottle wash part in a fourth embodiment.

FIG. 14 is a plan view showing a bottle wash part 330, 332 in a fourth embodiment.

Unlike the bottle wash part 330, 332 in the first embodiment, the bottle wash part 330, 332 in the fourth embodiment may include a plurality of connection parts 1030 having a straight line shape instead of a curved line shape. A structure of the plurality of connection parts 1030 having a straight line shape is only described hereunder.

Referring to FIG. 14, in the plan view, the plurality of connection parts 1030 may have a straight line shape. Specifically, a first sub connection part included respectively in the plurality of connection parts 1030 may have a straight line shape, and a second sub connection part included respectively in the plurality of connection parts 1030 may have a right angle shape or a horizontal line shape.

The first sub connection parts of the first connection part 1031, the second connection part 1032, the third connection part 1033 and the fourth connection part 1034 may have a straight line shape. That is, the first sub connection part may connect a lateral surface of the main bottle wash water guide 1010 and the first lateral surface of the sub bottle wash water guide 1021, 1022, 1023, 1024 in a straight line shape.

An angle between the straight line and the lateral surface of the main bottle wash water guide 1010 may be an acute angle.

The first sub connection part of the first connection part 1031 and the second sub connection part of the second connection part 1032 may have shapes that are reversed left to right except for a gradient of the straight line. Likewise, the first sub connection part of the third connection part 1033 and the first sub connection part of the fourth connection part 1034 may have shapes that are revered left to right except for a gradient of the straight line.

The second sub connection part of each of the first connection part 1031, the second connection part 1032, the third connection part 1033 and the fourth connection part 1034 may have the same shape as the bottle wash part 330, 332 in the first embodiment. Detailed description in relation to this is omitted.

A structure of the straight line of the first sub connection part, and a flow of wash water in the bottle wash water guide 330 based on the structure are described hereunder with reference to FIGS. 15A and 15B.

FIGS. 15A and 15B shows a shape of the bottle wash water guide 330 including a pair of first connection parts. Details provided below may also be applied to a pair of second connection parts.

As mentioned above, the first sub connection part of the first connection part 1031 and the second sub connection part of the second connection part 1032 may have a straight line shape. In this case, the straight lines of the first sub connection part of the first connection part 1031 and the first sub connection part of the second connection part 1032 may have an identical gradient or a different gradient. FIGS. 15A and 15B show examples in which the straight lines of the first sub connection part of the first connection part 1031 and the first sub connection part of the second connection part 1032 have the same gradient.

According to the present disclosure, an angle between the straight line and a lateral surface of the main bottle wash water guide 1010 may be an acute angle, as illustrated in FIG. 15A. Thus, wash water moving in the main wash water guide 1010 may flow to the first sub wash water guide 1021 and the second sub wash water guide 1022 smoothly.

Briefly, with the straight line structure of the plurality of connection parts 1030 described above, a spray height and a spray pressure of wash water spraying from the plurality of bottle nozzles 332 connected to the other ends of the plurality of sub bottle wash water guides 1020, may be uniformly controlled. That is, height of the wash water spraying from the plurality of bottle nozzles 332 and an amount of the wash water spraying from a single bottle nozzle 332 may be uniformized based on the above structure of the plurality of connection parts 1030.

Like the plurality of connection parts 1030 having a curved line shape, the plurality of connection parts 1030 having a straight line shape may allow of a smooth flow of wash water from the main bottle wash water guide 1010 to each of the plurality of sub bottle wash water guides 1020, thereby ensuring an increase in the flow rate of the wash water. Thus, a spray height of the plurality of bottle nozzles 332 connected to the plurality of sub bottle wash water guides 1020 may be uniformized, and a wash water spray height of each of the plurality of bottle nozzles 332 may be uniformized with time.

As described above, the straight lines of the plurality of connection parts 1030 may have an identical gradient or a different gradient. As a result of setting of the gradient of the straight line, wash water spraying from the plurality of nozzles 332 may spray at a uniform spray height.

The gradient of the straight line may be set with respect to the first lateral surface of the sub bottle wash water guide 1021, 1022, 1023, 1024. The gradient of the straight line of each of the plurality of connection parts 1030 may be set based on at least one of the positions at which the plurality of connection parts 1030 are disposed with respect to the wash water inlet of the main wash water guide 1010, the cross-sectional areas of the plurality of sub bottle wash water guides 1020 and the sizes of the plurality of nozzles 332.

In this case, when the gradient of the straight line is 45°, a largest amount of wash water may flow into the sub bottle wash water guide 1021, 1022, 1023, 1024. When the gradient of the straight line is greater than 45° or less than 45°, an amount of wash water flowing into the sub bottle wash water guide 1021, 1022, 1023, 1024 may be gradually reduced.

Accordingly, "setting the curvature of the curved line to a high value" may correspond to "setting the gradient of the straight line to a value close to 45°", and "setting the curvature of the curved line to a low value" may correspond to "setting the gradient of the straight line to a value close to 0° or 90°".

Details on the setting of the gradient of the straight line are similar to the details on the setting of the curvature of the curved line, which are provided above with reference to FIGS. 10 through 11B except for the above details. Accordingly, detailed description in relation to this is omitted.

Figure 16A:
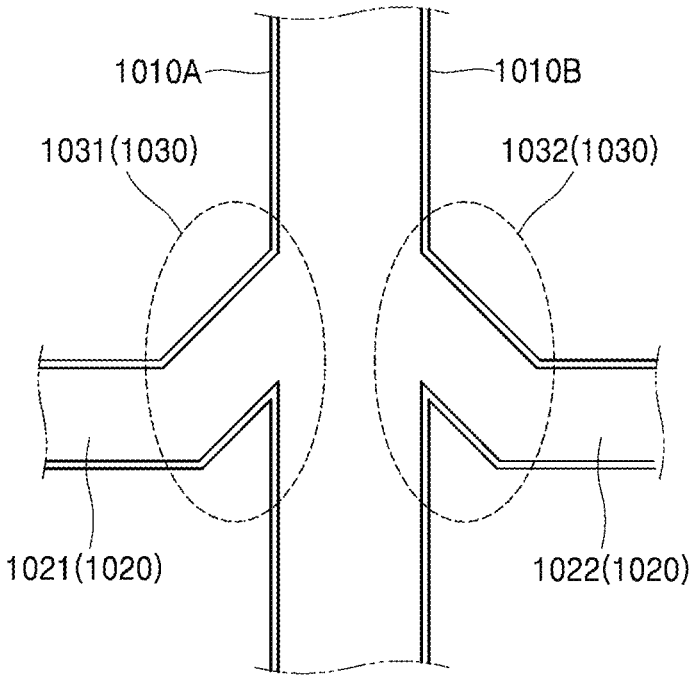
FIGS. 16A and 16B are plan views showing a bottle wash part in a fifth embodiment.
Figure 16B:
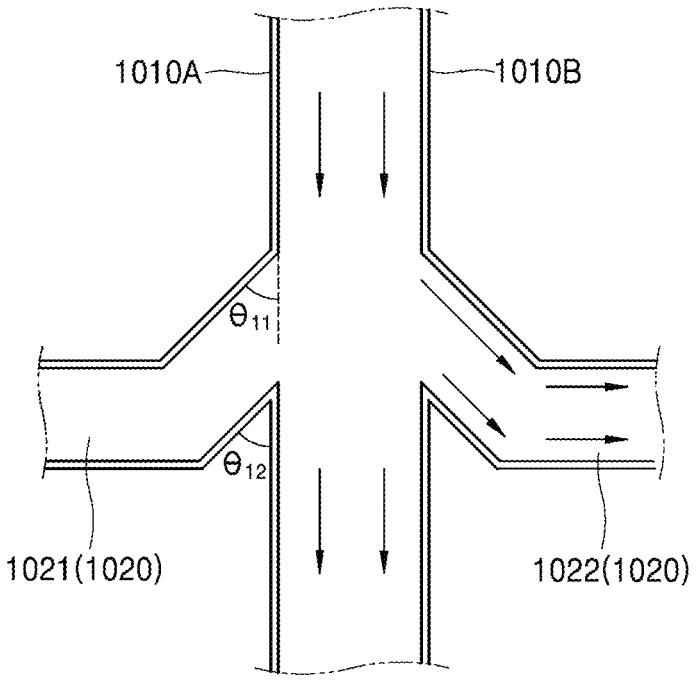

FIGS. 16A and 16B are plan view showing a part of a bottle wash part 330, 332 in a fifth embodiment.

That is, FIGS. 16A and 16B show another embodiment of the pair of first connection parts.

Referring to FIGS. 16A and 16B, the pair of first connection parts may include a connection part A1 and a connection part B1, and a first sub connection part and a second sub connection part included in the connection part A1 may all have a straight line shape, and a first sub connection part and a second sub connection part included in the connection part B1 may all have a straight line shape.

In other words, unlike the bottle wash part 330, 332 in the second embodiment, the bottle wash part 330, 332 in the fifth embodiment may include the plurality of connection parts 1030 having a straight line shape rather than a curved line shape.

Additionally, details on a structure of the plurality of connection parts 1030 having a straight line shape are the same as those provided with reference to FIGS. 14 through 15B.

Accordingly, the structure of the bottle wash part 330, 332 in the fifth embodiment is described above with reference FIGS. 12A, 12B, 14 through 15B.

Figure 17A:
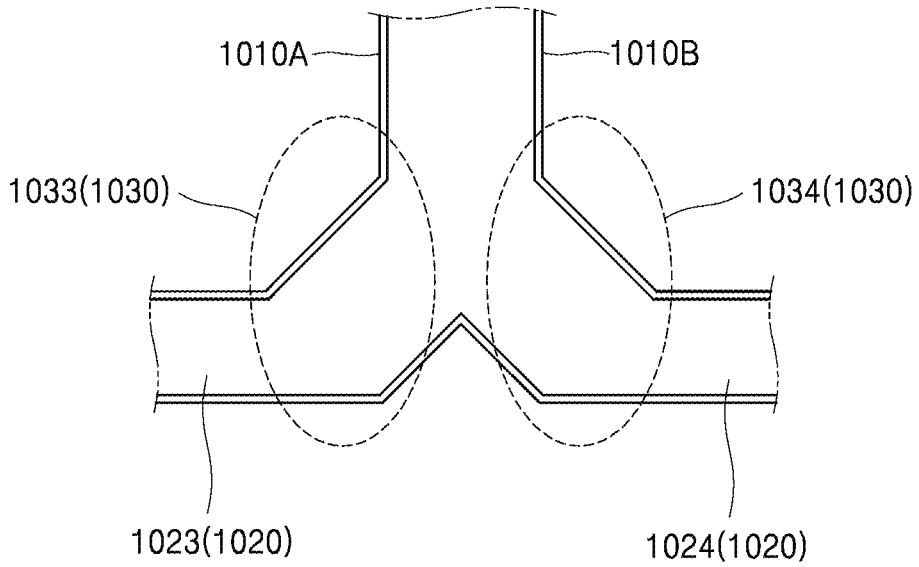
FIGS. 17A and 17B are plan views showing a bottle wash part in a sixth embodiment.
Figure 17B:
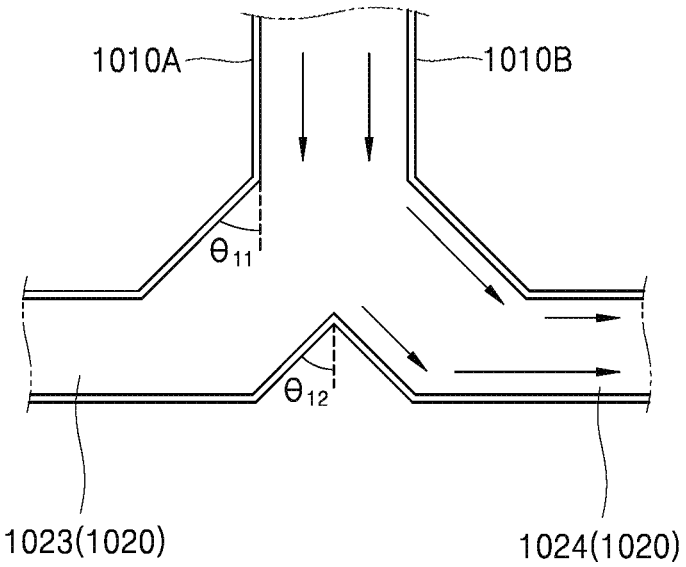

FIGS. 17A and 17B are plan views showing a part of a bottle wash part 330, 332 in a sixth embodiment.

That is, FIGS. 17A and 17B show another embodiment of the pair of second connection parts.

Referring to FIGS. 17A and 17B, the pair of second connection parts may include a connection part A2 and a connection part B2, and a first sub connection part and a second sub connection part included in the connection part A2 may all have a straight line shape, and a first sub connection part and a second sub connection part included in the connection part B2 may all have a straight line shape.

In other words, unlike the bottle wash part 330, 332 in the third embodiment, the bottle wash part 330, 332 in the sixth embodiment may include the plurality of connection parts 1030 having a straight line shape rather than a curved line shape.

Additionally, details on a structure of the plurality of connection parts 1030 having a straight line shape are the same as those provided with reference to FIGS. 14 through 15B.

Accordingly, the structure of the bottle wash part 330, 332 in the sixth embodiment is described above with reference to FIGS. 13A to 15B.

Figure 18:
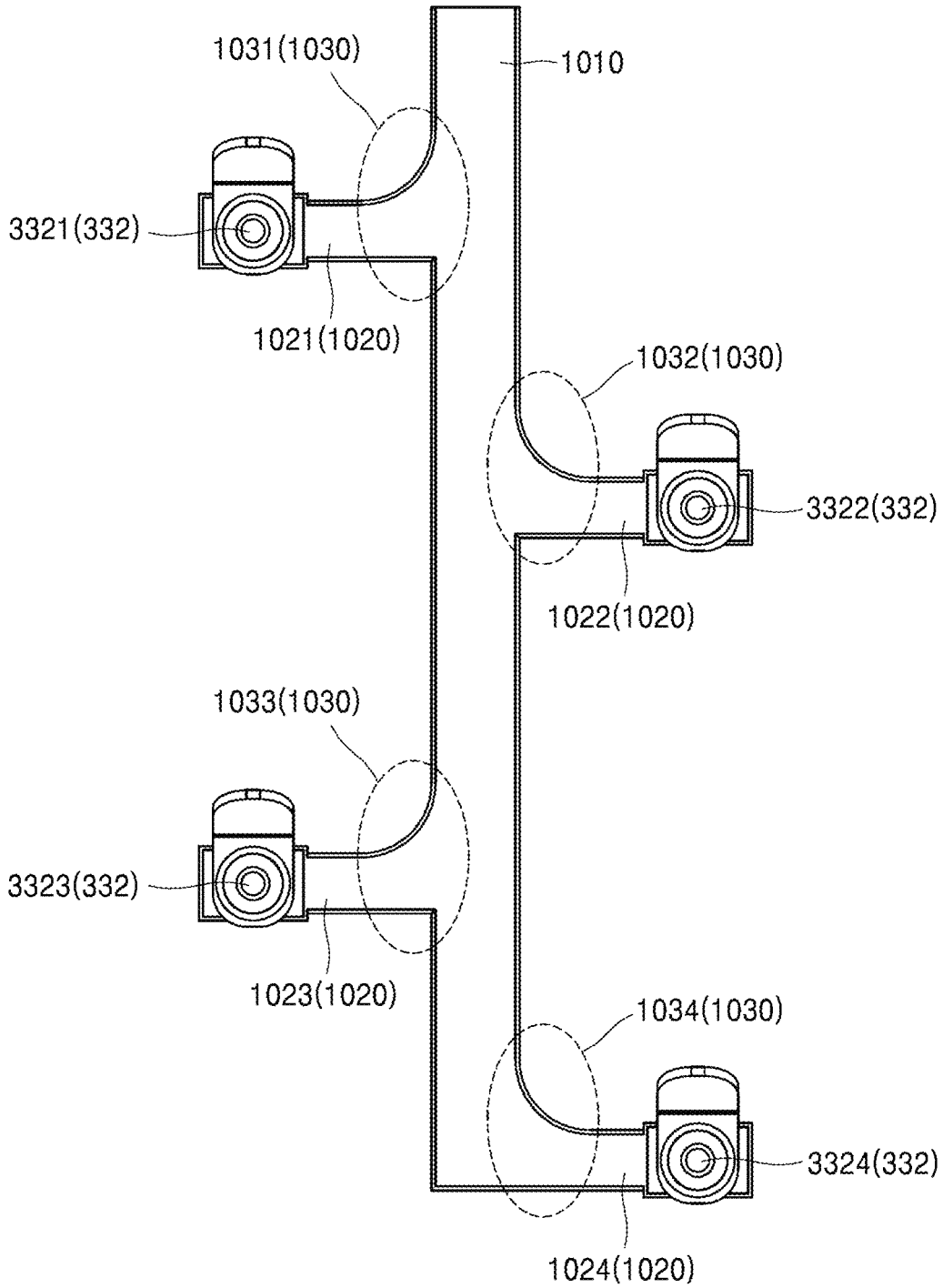
FIG. 18 is a plan view showing a bottle wash part in a seventh embodiment.

FIG. 18 is a plan view showing a bottle wash part 330, 332 in a seventh embodiment.

The bottle wash part 330, 332 in the seventh embodiment may be similar to the bottle wash part 330, 332 in the first embodiment except that the plurality of sub wash water guides 1020 is respectively disposed on the first lateral surface and the second lateral surface of the main wash water guide 1010 in a zigzag shape. In this case, the sub wash water guide 1020 disposed respectively on the first lateral surface and the second lateral surface of the main wash water guide 1010 may be identical or different. For example, the number of the sub wash water guides 1020 disposed on the first lateral surface of the main wash water guide 1010 may be an odd number, and the number of the sub wash water guides 1020 disposed on the second lateral surface of the main wash water guide 1010 may be an even number.

A shape of the plurality of connection parts 1030 of the bottle wash part 330, 332 in the seventh embodiment may correspond to the shape of the plurality of connection parts 1030 of the bottle wash part 330, 332 in the first embodiment.

Accordingly, the structure of the bottle wash part 330, 332 in the seventh embodiment is described above with reference to FIGS. 10 and 11B.

The shape of the plurality of connection parts 1030 of the bottle wash part 330, 332 in the seventh embodiment may correspond to the shape of the plurality of connection parts 1030 illustrated in FIGS. 12A through 13B. Further, the plurality of connection parts 1030 of the bottle wash part 330, 332 in the seventh embodiment may have a straight line shape as illustrated in FIGS. 14 through 17B. Description in relation to this is provided above with reference to FIGS. 12A to 17B.

Figure 19:
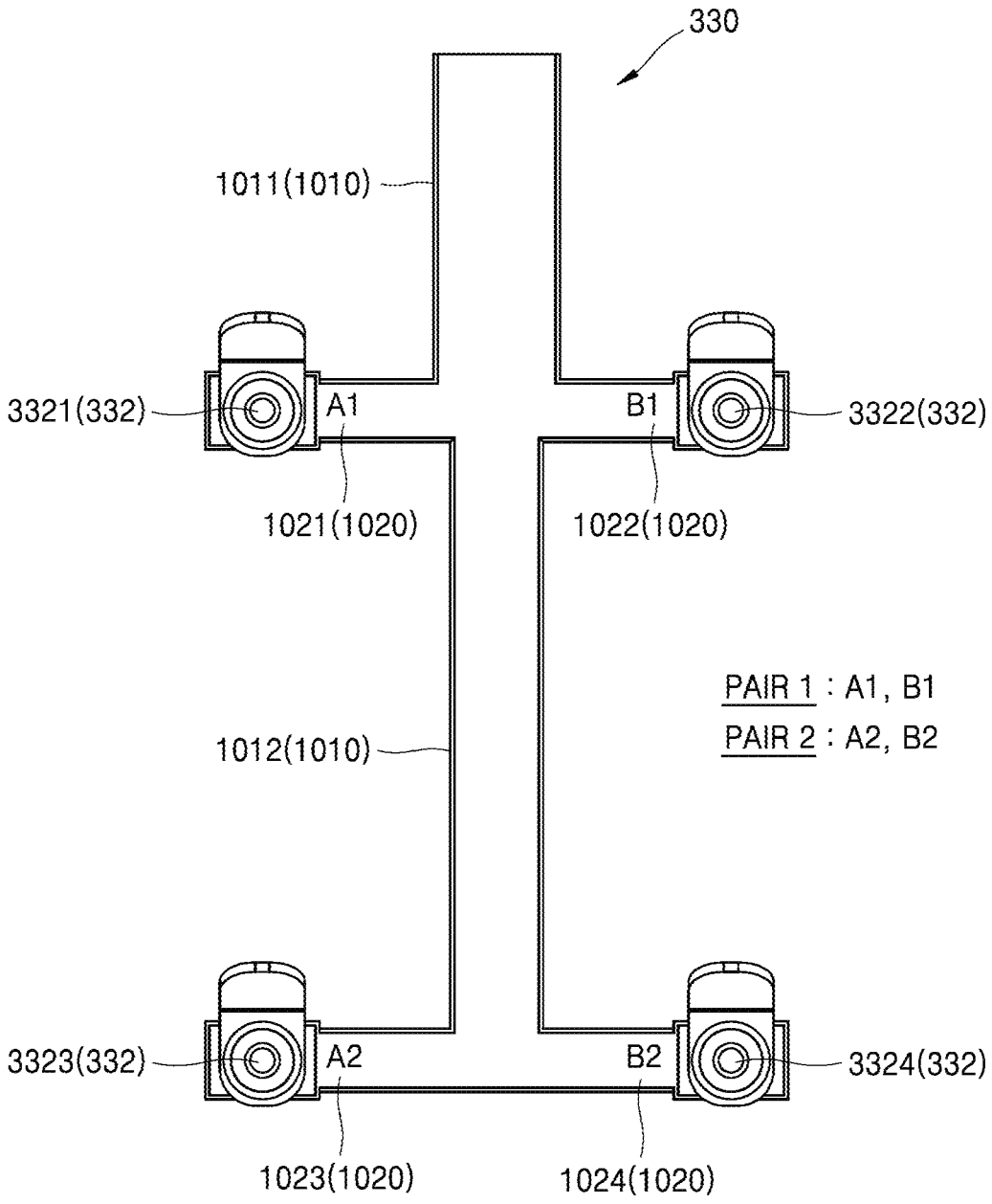
FIG. 19 is a plan view showing a bottle wash part in an eighth embodiment.

FIG. 19 is a plan view showing a bottle wash part 330, 332 in an eighth embodiment.

Referring to FIG. 19, in the bottle wash part 330, 332 of the eighth embodiment, the cross-sectional area of the main wash water guide 1010 may be reduced in a lengthwise direction with respect to the wash water inlet of the main wash water guide 1010, such that wash water spraying from the plurality of nozzles 332 sprays at a uniform spray height.

Prior to description of the bottle wash part 330, 332 in the eighth embodiment, suppose that the plurality of sub bottle wash water guides 1020 all has the same cross-sectional area and that the plurality of bottle nozzles 332 has the same size and that the plurality of connection parts 1030 has a right angle shape or a horizontal line shape, for convenience of description.

Referring to FIGS. 17A and 17B, the cross-sectional area of the main bottle wash water guide 1010 is non-uniform. That is, the main bottle wash water guide 1010 may include a first portion 1011 of the main bottle wash water guide 1010, disposed between the wash water inlet of the main bottle wash water guide 1010 and a pair of first sub bottle wash water guides (PAIR 1), and a second portion 1012 of the main bottle wash water guide 1010, disposed between the pair of first sub bottle wash water guides (PAIR 1) and a pair of second sub bottle wash water guides (PAIR 2).

In an embodiment, a cross-sectional area of the second portion 1012 of the main bottle wash water guide b 1010 may be less than a cross-sectional area of the first portion 1011 of the main bottle wash water guide 1010.

That is, the cross-sectional area of the first portion 1011 of the main bottle wash water guide 1010 may be uniform, and the cross-sectional area of the second portion 1012 of the main bottle wash water guide 1010 may be uniform. Additionally, the cross-sectional area of the second portion 1012 of the main bottle wash water guide 1010 may be less than the cross-sectional area of the first portion 1011 of the main bottle wash water guide 1010. With the configuration, wash water spraying from the plurality of bottle nozzles 332 may spray at a uniform spray height.

Specifically, some of the wash water moving into the main wash water guide 1010 may flow to the first sub bottle wash water guide 1021 and the second sub bottle wash water guide 1022 that are primarily branched from the main wash water guide 1010. When the cross-sectional area of the first portion 1011 of the main bottle wash water guide 1010 is the same as the cross-sectional area of the second portion 1012 of the main bottle wash water guide 1010, a flow rate of wash water of the second portion 1012 of the main bottle wash water guide 1010 may be less than a flow rate of wash water of the first portion 1011 of the main bottle wash water guide 1010, and a sufficient amount of wash water may not be supplied to the third sub bottle wash water guide 1023 and the fourth sub bottle wash water guide 1024 that are secondarily branched from the main wash water guide 1010.

To solve the above problem, the cross-sectional area of the first portion 1011 of the main bottle wash water guide 1010 may be configured to be greater than the cross-sectional area of the second portion 1012 of the main bottle wash water guide 1010 in the eighth embodiment. That is, since the cross-sectional area of the second portion 1012 of the main bottle wash water guide 1010 is less than the cross-sectional area of the first portion 1011 of the main bottle wash water guide 1010, pressure of wash water may increase such that a spray height of the third bottle nozzle 1033 and the fourth bottle nozzle 1034 increases. Thus, a spray pressure and a spray height of wash water spraying from the plurality of bottle nozzles 332 may become identical.

The shape of the plurality of connection parts 1030, described with reference to FIGS. 10 to 17B, may be applied to the bottle wash part 330, 332 in the eighth embodiment. In this case, the cross-sectional area of the main bottle wash water guide 1010 and the shape of the plurality of connection parts 1030 may be configured to make the spray height of wash water spraying from the plurality of bottle nozzles 332 equal.

Figure 20:
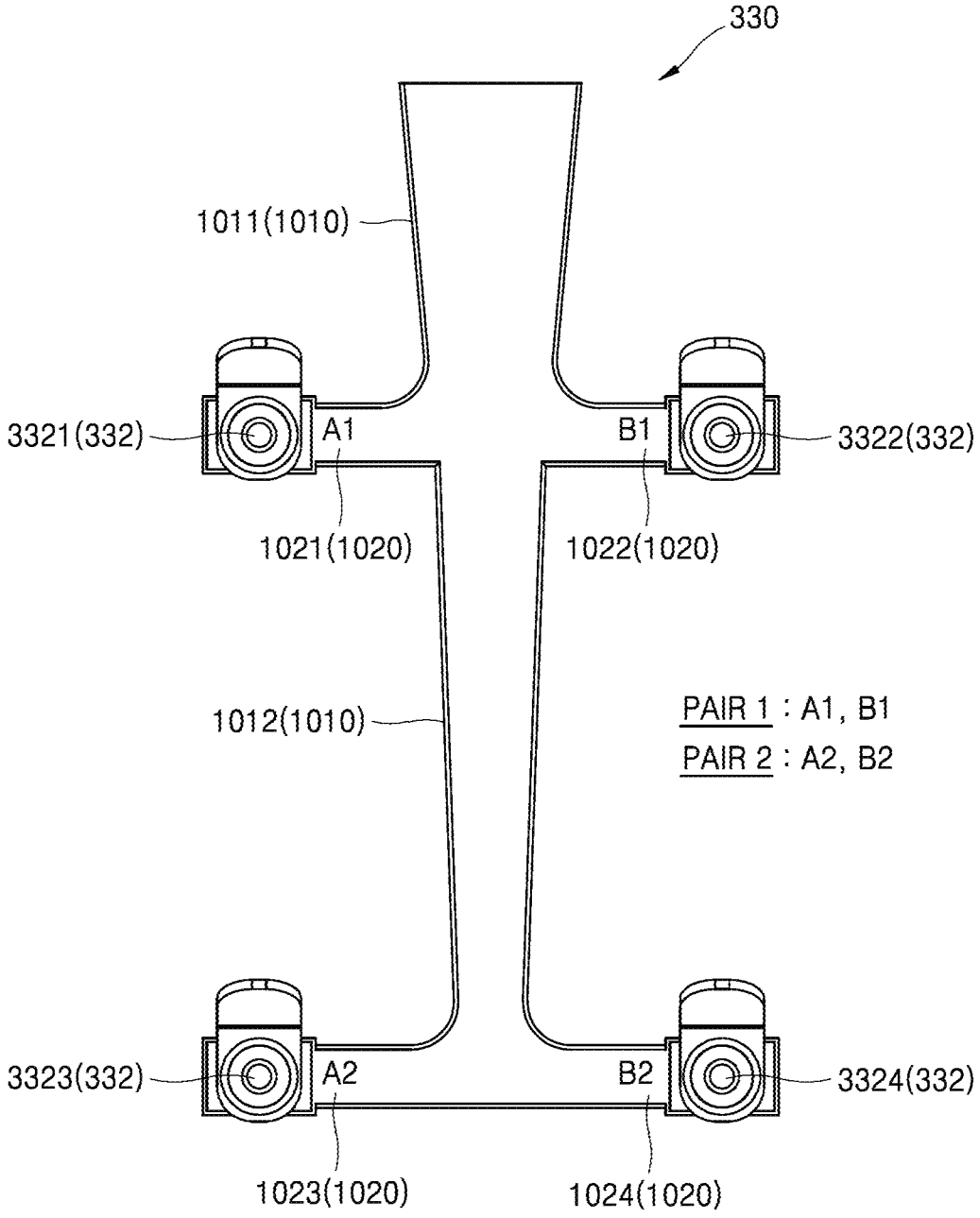
FIG. 20 is a plan view showing a bottle wash part in a ninth embodiment.

FIG. 20 is a plan view showing a bottle wash part 330, 332 in a ninth embodiment.

Referring to FIG. 20, the bottle wash part 330, 332 of the ninth embodiment may be the same as the bottle wash part 330, 332 of the eighth embodiment in that the cross-sectional area of the main wash water guide 1010 may be reduced in a lengthwise direction with respect to the wash water inlet of the main wash water guide 1010 such that wash water spraying from the plurality of nozzles 332 sprays at a uniform spray height.

However, the bottle wash part 330, 332 of the ninth embodiment may be different from the bottle wash part 330, 332 of the eighth embodiment in that the cross-sectional areas of the first portion 1011 and the second portion 1012 of the main bottle wash water guide 1010 are non-uniform.

The cross-sectional area of at least one of the first portion 1011 and the second portion 1012 of the main bottle wash water guide 1010 may be gradually reduced in the lengthwise direction of the main bottle wash water guide 1010.

That is, a cross-sectional area of one end of the first portion 1011 of the main bottle wash water guide 1010 may be greater than or the same as a cross-sectional area of the other end of the first portion 1011 of the main bottle wash water guide 1010, a cross-sectional area of one end of the second portion 1012 of the main bottle wash water guide 1010 may be greater than or the same as a cross-sectional area of the other end of the second portion 1012 of the main bottle wash water guide 1010, and the cross-sectional area of the other end of the first portion 1011 of the main bottle wash water guide 1010 may be greater than the cross-sectional area of one end of the second portion 1012 of the main bottle wash water guide 1010.

Herein, one end of the first portion 1011 of the main bottle wash water guide 1010 may be disposed closer to t the wash water inlet of the main bottle wash water guide 1010 than the other end of the first portion 1011 of the main bottle wash water guide 1010, and one end of the second portion 1012 of the main bottle wash water guide 1010 may be disposed closer to the wash water inlet of the main bottle wash water guide 1010 than the other end of the second portion 1012 of the main bottle wash water guide 1010.

Thus, a spray height of wash water spraying from the plurality of bottle nozzles 322 may be uniformized as in the main bottle wash water guide 1010 of the ninth embodiment.

Referring to FIG. 20, the plurality of connection parts 1030 may have a shape similar to that of the plurality of connection parts in FIG. 10. That is, a first sub connection part included respectively in the plurality of connection parts 1030 may have a curved line shape of an acute angle, and a second sub connection part included respectively in the plurality of connection parts 1030 may have a right angle shape or a horizontal line shape. As a result of combination of the shape of the plurality of connection parts 1030 and the shape of the main bottle wash water guide 1010, a spray height of wash water spraying from the plurality of bottle nozzles 332 may be uniformized.

The shape of the plurality of connection parts 1030, described with reference to FIGS. 10 to 17B, may be applied to the bottle wash part 330, 332 in the ninth embodiment. In this case, the cross-sectional area of the main bottle wash water guide 1010 the shape of the plurality of connection parts 1030 may be configured to make the spray height of wash water spraying from the plurality of bottle nozzles 332 equal.

Figure 21:
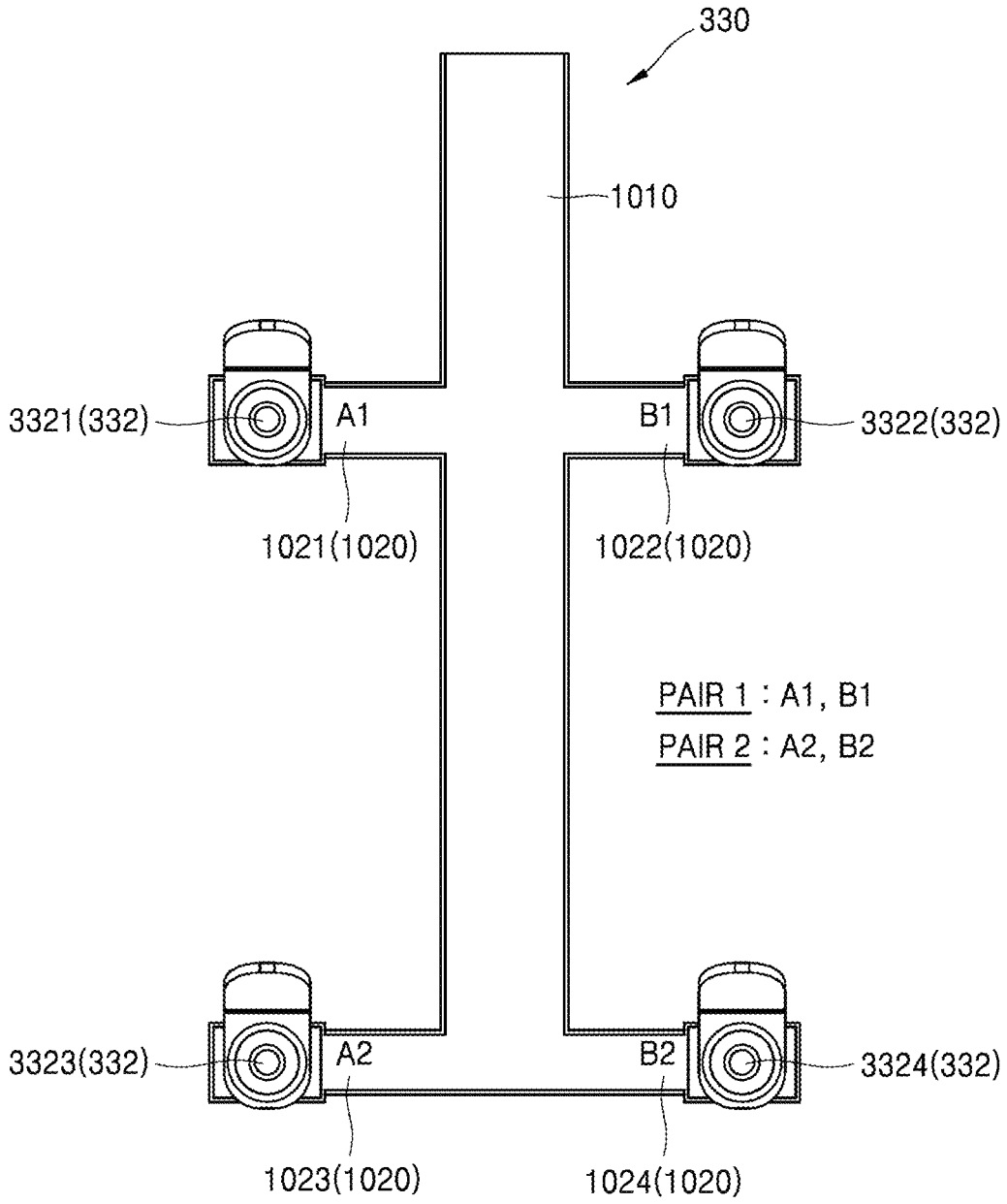
FIG. 21 is a plan view showing a bottle wash part in a tenth embodiment.

FIG. 21 is a plan view showing a bottle wash part 330, 332 in a tenth embodiment.

Referring to FIG. 21, in the bottle wash part 330, 332 of the tenth embodiment, the plurality of sub bottle wash water guides 1020 may have a different cross-sectional area such that wash water spraying from the plurality of nozzles 332 sprays at a uniform spray height.

Prior to description of the bottle wash part 330, 332 in the tenth embodiment, suppose that the main bottle wash water guide 1010 has the same cross-sectional area and that the plurality of bottle nozzles 332 has the same size and that the plurality of connection parts 1030 has a right angle shape or a horizontal line shape, for convenience of description.

Referring to FIG. 21, cross-sectional areas of a first sub bottle wash water guide 1021 and a second sub bottle wash water guide 1022 included in the pair of first sub bottle wash water guides (PAIR 1) may be the same, and cross-sectional areas of a third sub bottle wash water guide 1023 and a fourth sub bottle wash water guide 1024 included in the pair of second sub bottle wash water guides (PAIR 2) may be the same. The cross-sectional areas of the third sub bottle wash water guide 1023 and the fourth sub bottle wash water guide 1024 may be less than the cross-sectional areas of the first sub bottle wash water guides 1021 and the second sub bottle wash water guides 1022.

Specifically, some of the wash water moving into the main wash water guide 1010 may flow to the first sub bottle wash water guide 1021 and the second sub bottle wash water guide 1022 that are primarily branched from the main wash water guide 1010. When the cross-sectional area of the first portion of the main bottle wash water guide 1010 is the same as the cross-sectional area of the second portion of the main bottle wash water guide 1010, a flow rate of wash water of the second portion of the main bottle wash water guide 1010 may be less than a flow rate of wash water of the first portion of the main bottle wash water guide 1010.

Accordingly, in the tenth embodiment, the cross-sectional areas of the third sub bottle wash water guide 1023 and the fourth sub bottle wash water guide 1024 disposed far from the wash water inlet of the main bottle wash water guide 1010 may be configure to be less than the cross-sectional areas of the first sub bottle wash water guide 1021 and the second sub bottle wash water guide 1022 disposed near the wash water inlet of the main bottle wash water guide 1010. That is, when the cross-sectional areas of the third sub bottle wash water guide 1023 and the fourth sub bottle wash water guide 1024 are reduced, flow velocity of wash water may increase, and based on the increased flow velocity, a spray height of the third bottle nozzle 1033 and the fourth bottle nozzle 1034 may be raised. Thus, a spray pressure and a spray height of wash water spraying from the plurality of bottle nozzles 332 may become identical.

Further, the cross-sectional areas of the third sub bottle wash water guide 1023 and the fourth sub bottle wash water guide 1024 may be configured to differ, and the sizes of the third bottle nozzle 1033 and the fourth bottle nozzle 1034 may be configured to differ.

That is, the sizes of the third bottle nozzle 1033 and the fourth bottle nozzle 1034 may be configured to be less than the sizes of the first bottle nozzle 1031 and the second bottle nozzle 1032. A decrease in the size of the nozzle may result in an increase in the spray height of wash water spraying from the nozzle. Thus, the spray height and pressure of wash water spraying from the plurality of bottle nozzles 332 may be further uniformized.

The shape of the plurality of connection parts 1030, described with reference to FIGS. 10 to 17B, may be applied to the bottle wash part 330, 332 in the tenth embodiment. In this case, the cross-sectional area of the main bottle wash water guide 1010 and the shape of the plurality of connection parts 1030 may be configured to make the spray height of wash water spraying from the plurality of bottle nozzles 332 equal.

The embodiments are described above with reference to a number of illustrative embodiments thereof. However, the present disclosure is not intended to limit the embodiments and drawings set forth herein, and numerous other modifications and embodiments can be devised by one skilled in the art without departing from the technical spirit of the disclosure. Further, the effects and predictable effects based on the configurations in the disclosure are to be included within the range of the disclosure though not explicitly described in the description of the embodiments.

What is claimed is:

1. A dishwasher, comprising:

a tub defining a washing space;

a sump that is disposed at a lower portion of the washing space and that is configured receive water;

a plurality of nozzles that is disposed at the washing space and that is configured to spray the water received in the sump toward an object in an upward direction; and a wash water guide that is configured to supply the water in the sump to each of the plurality of nozzles and that is disposed at the washing space, wherein the wash water guide comprises a main wash water guide, a plurality of sub wash water guides respectively branched from the main wash water guide, and a plurality of connection parts connecting the main wash water guide to the plurality of sub wash water guides, and wherein an angle between at least one connection part of the plurality of connection parts and the main wash water guide is an acute angle.

2. The dishwasher of claim 1, wherein:

each of the plurality of connection parts comprises (i) a first sub connection part connecting the main wash water guide to a first lateral surface of the sub wash water guide and (ii) a second sub connection part connecting the main wash water guide to a second lateral surface of the sub wash water guide, and a first distance between the first lateral surface of the sub wash water guide and a wash water inlet of the main wash water guide is shorter than a second distance between the second lateral surface of the sub wash water guide and the wash water inlet of the main wash water guide.

3. The dishwasher of claim 2, wherein at least one of the plurality of connection parts is curved.

4. The dishwasher of claim 3, wherein:

the plurality of sub wash water guides comprises one or more pairs of sub wash water guides spaced apart from each other with respect to the wash water inlet of the main wash water guide, and each of the one or more pairs of sub wash water guides comprises a first sub wash water guide part and a second sub wash water guide part facing each other, the plurality of connection parts comprises one or more pairs of connection parts, and each of the one or more pairs of connection parts comprises a first connector connected to the first sub wash water guide part and a second connector connected to the second sub wash water guide part, and the plurality of nozzles comprises a first nozzle connected to the first sub wash water guide part and a second nozzle connected to the second sub wash water guide part.

5. The dishwasher of claim 4, wherein:

a first part of the first connector that connects a first lateral surface of the first sub wash water guide part to a first lateral surface of the main wash water guide is curved, and a first part of the second connector that connects a first lateral surface of the second sub wash water guide part to a second lateral surface of the main wash water guide is curved.

6. The dishwasher of claim 5, wherein:

a second part of the first connector that connects a second lateral surface of the first sub wash water guide to the first lateral surface of the main wash water guide has a shape of a right angle or a horizontal line, and a second part of the second connector that connects a second lateral surface of the second sub wash water guide to a second lateral surface of the main wash water guide has a shape of a right angle or a horizontal line.

7. The dishwasher of claim 5, wherein:

a second part of the first connector that connects a second lateral surface of the first sub wash water guide to the first lateral surface of the main wash water guide is curved, and a second part of the second connector that connects a second lateral surface of the second sub wash water guide to the second lateral surface of the main wash water guide is curved.

8. The dishwasher of claim 5, wherein:

a second part of the first connector that connects a second lateral surface of the first sub wash water guide to a central line of the main wash water guide is curved, and a second part of the second connector that connects a second lateral surface of the second sub wash water guide to the central line of the main wash water guide is curved.

9. The dishwasher of claim 4, wherein a curvature of the at least one of the plurality of connection parts is (i) directly proportional to a size of each of the first nozzle and the second nozzle and (ii) inversely proportional to a cross-sectional area of each of the first sub wash water guide part and the second sub wash water guide part.

10. The dishwasher of claim 4, wherein, based on a size of the first nozzle and a size of the second nozzle being equal and a cross-sectional area of the first sub wash water guide part and a cross-sectional area of the second sub wash water guide part being equal, a curvature of the first connector and a curvature of the second connector are same.

11. The dishwasher of claim 4, wherein, based on a cross-sectional area of the first sub wash water guide part and a cross-sectional area of the second sub wash water guide part being equal and a size of the first nozzle being greater than a size of the second nozzle, a curvature of the first connector is greater than a curvature of the second connector.

12. The dishwasher of claim 4, wherein, based on a size of the first nozzle and a size of the second nozzle being equal and a cross-sectional area of the first sub wash water guide part being greater than a cross-sectional area of the second sub wash water guide part, a curvature of the first connector is less than a curvature of the second connector.

13. The dishwasher of claim 3, wherein:

any one connection part of the at least one of the plurality of connection parts is closer to the wash water inlet of the main wash water guide than the other connection part of the at least one of the plurality of connection parts, and a curvature of the any one connection part is less than a curvature of the other connection part.

14. The dishwasher of claim 1, wherein a cross-sectional area of the main wash water guide decreases as a distance from a washing water inlet of the main wash water guide increases.

15. The dishwasher of claim 14, wherein:

any one sub wash water guide of the plurality of sub wash water guides is closer to the wash water inlet of the main wash water guide than the other sub wash water guide of the plurality of sub wash water guides, and a cross-sectional area of a first portion of the main wash water guide disposed between the any one wash water guide and the wash water inlet of the main wash water guide is greater than a cross-sectional area of a second portion of the main wash water guide disposed between the any one sub wash water guide and the other sub wash water guide.

16. The dishwasher of claim 15, wherein:

a cross-sectional area of a first end of the first portion of the main wash water guide is greater than or equal to a cross-sectional area of a second end of the first portion of the main wash water guide, a cross-sectional area of a first end of the second portion of the main wash water guide is greater than or equal to a cross-sectional area of a second end of the second portion of the main wash water guide, the cross-sectional area of the second end of the first portion of the main wash water guide is greater than the cross-sectional area of the first end of the second portion of the main wash water guide, the first end of the first portion of the main wash water guide is closer to the wash water inlet of the main wash water guide than the second end of the first portion of the main wash water guide, and the first end of the second portion of the main wash water guide is closer to the wash water inlet of the main wash water guide than the second end of the second portion of the main wash water guide.

17. The dishwasher of claim 1, wherein the plurality of sub wash water guides and the plurality of connection parts have a zigzag shape and are disposed on a first lateral surface and a second lateral surface of the main wash water guide.

18. The dishwasher of claim 1, wherein:

any one sub wash water guide of the plurality of sub wash water guides is closer to a wash water inlet of the main wash water guide than the other sub wash water guide of the plurality of sub wash water guides, and a cross-sectional area of the other sub wash water guide is less than a cross-sectional area of the any one sub wash water guide.

* * * * *